US012453878B2

(12) United States Patent
Schroeder et al.

(10) Patent No.: US 12,453,878 B2
(45) **Date of Patent: *Oct. 28, 2025**

(54) MODULAR WEIGHT STATION

(71) Applicant: Samson Equipment, Inc., Fairacres, NM (US)

(72) Inventors: Brian Lee Schroeder, Columbia, MO (US); David Lee Schroeder, Las Cruces, NM (US); Oliver Matthew Johnson, Las Cruces, NM (US)

(73) Assignee: Samson Equipment, Inc., Fairacres, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/742,864

(22) Filed: Jun. 13, 2024

(65) Prior Publication Data

US 2024/0408430 A1 Dec. 12, 2024

Related U.S. Application Data

(63) Continuation of application No. 17/683,824, filed on Mar. 1, 2022, now Pat. No. 12,048,858, which is a continuation-in-part of application No. 17/319,397, filed on May 13, 2021, now Pat. No. 11,707,662.

(60) Provisional application No. 63/029,905, filed on May 26, 2020, provisional application No. 63/024,404, filed on May 13, 2020.

(51) Int. Cl.
*A63B 21/00* (2006.01)
*A63B 21/062* (2006.01)

(52) U.S. Cl.
CPC ..... *A63B 21/00047* (2013.01); *A63B 21/151* (2013.01); *A63B 21/4043* (2015.10); *A63B 21/0628* (2015.10); *A63B 2225/09* (2013.01)

(58) Field of Classification Search
CPC ..... A63B 21/00047
See application file for complete search history.

(56) References Cited

U.S. PATENT DOCUMENTS 4,635,934 A * 1/1987 Roethke ..... A63B 23/00 482/104
4,781,374 A * 11/1988 Lederman ..... A63B 21/154 482/99
4,974,838 A * 12/1990 Sollenberger ..... A63B 21/155 482/102
6,685,601 B1 * 2/2004 Knapp ..... A63B 21/0783 482/142
7,488,277 B1 * 2/2009 Knapp ..... A63B 21/0626 482/106

(Continued)

FOREIGN PATENT DOCUMENTS

WO WO-2005002678 A2 * 1/2005 ..... A63B 21/00065

*Primary Examiner* — Joshua K Ihezie
(74) *Attorney, Agent, or Firm* — Larry E. Henneman, Jr.; Baker & Rannells, PA

(57) ABSTRACT

A novel modular weight station includes a frame, a first set of receivers, and a second set of receivers. The frame includes a first support column, a second support column, and a cross support coupled between the first and second support columns. The first set of receivers are coupled to the frame and orientated to face in a first direction while the second set of receivers are coupled to the frame and oriented to face in a second direction. The receivers are configured to removably engage an additional structural component.

20 Claims, 35 Drawing Sheets

(56) References Cited

U.S. PATENT DOCUMENTS

| | | | | |
|---|---|---|---|---|
| 9,192,799 | B2 * | 11/2015 | Alenaddaf | A63B 71/0036 |
| 9,278,246 | B2 * | 3/2016 | Tambornino | A63B 21/078 |
| 9,597,539 | B2 * | 3/2017 | Grider | A63B 21/00047 |
| 11,273,337 | B2 * | 3/2022 | George | A63B 1/00 |
| D973,155 | S * | 12/2022 | Gong | D21/673 |
| 11,707,662 | B1 * | 7/2023 | Schroeder | A63B 71/02 52/126.6 |
| 2007/0099773 | A1 * | 5/2007 | Hummer | A63B 21/078 482/104 |
| 2014/0200117 | A1 * | 7/2014 | Grider | A63B 17/04 482/104 |
| 2014/0243174 | A1 * | 8/2014 | Alenaddaf | A63B 21/15 482/142 |
| 2015/0076092 | A1 * | 3/2015 | Tambornino | A63B 21/078 211/85.7 |
| 2015/0321048 | A1 * | 11/2015 | Ross | A63B 22/0005 482/92 |
| 2019/0240521 | A1 * | 8/2019 | Staten | A63B 23/1218 |
| 2019/0275364 | A1 * | 9/2019 | Saunders | A63B 21/0004 |
| 2020/0139181 | A1 * | 5/2020 | Thomas | A63B 1/00 |
| 2020/0171340 | A1 * | 6/2020 | Hsu | A63B 21/0628 |
| 2020/0222739 | A1 * | 7/2020 | George | A63B 1/00 |
| 2020/0254295 | A1 * | 8/2020 | Watterson | A63B 21/00192 |
| 2021/0228935 | A1 * | 7/2021 | Duplechain | A47B 83/001 |
| 2021/0394003 | A1 * | 12/2021 | Gore | A63B 21/00065 |
| 2022/0305325 | A1 * | 9/2022 | Souffrain | A63B 1/00 |

* cited by examiner

MODULAR WEIGHT STATION

RELATED APPLICATIONS

This application is a continuation of co-pending U.S. patent application Ser. No. 17/683,824, filed on Mar. 1, 2022 by at least one common inventor, which is a continuation-in-part of U.S. patent application Ser. No. 17/319,397, filed on May 13, 2021 by at least one common inventor, which claims the benefit of U.S. Provisional Patent Application No. 63/029,905, filed on May 26, 2020 by at least one common inventor, and also claims the benefit of U.S. Provisional Patent Application No. 63/024,404, filed on May 13, 2020 by at least one common inventor, all of which are incorporated herein by reference in their respective entireties.

BACKGROUND OF THE INVENTION

Field of the Invention

This invention relates generally to exercise equipment, and more particularly to free weight and cable weight stations.

Description of the Background Art

High quality exercise equipment can require a significant investment for commercial gymnasiums, schools, and other entities. Oftentimes, purchase decisions must balance available budget against desired features of the exercise equipment and compromises can be required. Later, when additional funds become available and new equipment is purchased, the previously purchased equipment can become obsolete or redundant.

In addition, different purchasing entities can have different desires or requirements, with respect to the exercise equipment they purchase. It is difficult to predict such needs and desires in advance, and so it is difficult and/or costly to manufacture and maintain sufficient stock to be able to readily meet the varied demands of the different purchasing entities. As a result, it is common for high-end exercise equipment to be custom designed and built after an order for the equipment is placed. While keeping unsold inventory to a minimum, this practice significantly lengthens the time required to deliver purchased equipment. In addition, manufacturing processes for custom equipment are less efficient and, therefore, more expensive.

SUMMARY

The present invention overcomes the problems associated with the prior art by providing a core frame, to which modular components can be attached to realize a great multitude of equipment configurations. The invention facilitates building on to existing configurations without rendering the original equipment obsolete, cases inventory requirements, and improves lead times for custom equipment configuration and delivery.

An example modular weight station includes a frame, a first set of receivers, and a second set of receivers. The frame includes a first support column, a second support column, and a cross support coupled between the first support column and the second support column. The first set of receivers is coupled to the frame and oriented to face in a first direction. Each receiver of the first set of receivers can be configured to removably engage an additional structural component. The second set of receivers is also coupled to the frame, but oriented to face in a second direction different from the first direction. Each receiver of the second set of receivers can also be configured to removably engage an additional structural component.

The example modular weight station can additionally include a plurality of connectors; for example a first connector, a second connector, a third connector, and a fourth connector. The first support column can include a first upright and a second upright, and the second support column can include a third upright and a fourth upright. The cross support can include a first transverse member coupled between the first upright and the third upright, and the cross support can additionally include a second transverse member coupled between the second upright and the fourth upright. The first connector can be coupled between the first upright and the second upright, and the second connector can also be coupled between the first upright and the second upright. The third connector can be coupled between the third upright and the fourth upright, and the fourth connector can also be coupled between the third upright and the fourth upright. A first receiver of the first set of receivers can be fixed to a first end of the first connector, and a second receiver of the first set of receivers can be fixed to a first end of the second connector. A third receiver of the first set of receivers can be fixed to a first end of the third connector, and a fourth receiver of the first set of receivers can be fixed to a first end of the fourth connector. A first receiver of the second set of receivers can be fixed to a second end of the first connector, and a second receiver of the second set of receivers can be fixed to a second end of the second connector. A third receiver of the second set of receivers can be fixed to a second end of the third connector, and a fourth receiver of the second set of receivers can be fixed to a second end of the fourth connector.

In example modular weight stations, the first connector can define a cable passage passing completely through the first connector. The cable passage facilitates the movement of a weight cable through the first connector. Example modular weight stations can additionally include a cable-weight assembly removably coupled to the frame.

Example modular weight stations can additionally include one or more couplers. In some configurations, the couplers can be used to attach extenders/legs to opposite sides of the bottom of the frame. For example, a first coupler can have a first portion and an opposite second portion, and the first portion of the first coupler can be configured to be removably mounted to the first receiver of the first set of the receivers. A second coupler can have a first portion and an opposite second portion, and the first portion of the second coupler can be configured to be removably mounted to the third receiver of the first set of the receivers. A third coupler can have a first portion and an opposite second portion, and the first portion of the third coupler can be configured to be removably mounted to the first receiver of the second set of the receivers. A fourth coupler can have a first portion and an opposite second portion, and the first portion of the fourth coupler being configured to be removably mounted to the third receiver of the second set of the receivers. A first frame extender can have a first portion and an opposite second portion, and the first portion of the first frame extender can be configured to be removably mounted to the second portion of the first coupler. A second frame extender can have a first portion and an opposite second portion, and the first portion of the second frame extender can be configured to be removably mounted to the second portion of the second coupler. A third frame extender can have a first portion and an opposite second portion, and the first portion of the third frame extender can be configured to be removably mounted to the second portion of the third coupler. A fourth frame extender can have a first portion and an opposite second portion, and the first portion of the fourth frame extender can be configured to be removably mounted to the second portion of the fourth coupler. Optionally, the first frame extender can be longer than the third frame extender, and the second frame extender can be longer than the fourth frame extender.

In other example configurations, the couplers can be used to attach frame extenders to the top and bottom of the same side of the frame. For example, a first coupler can have a first portion and an opposite second portion, and the first portion of the first coupler can be configured to be removably mounted to the first receiver of the first set of the receivers. A second coupler can have a first portion and an opposite second portion, and the first portion of the second coupler can be configured to be removably mounted to the second receiver of the first set of the receivers. A third coupler can have a first portion and an opposite second portion, and the first portion of the third coupler being configured to be removably mounted to the third receiver of the first set of the receivers. A fourth coupler can have a first portion and an opposite second portion, and the first portion of the fourth coupler can be configured to be removably mounted to the fourth receiver of the first set of the receivers. A first frame extender can have a first portion and an opposite second portion, and the first portion of the first frame extender can be configured to be removably mounted to the second portion of the first coupler. A second frame extender can have a first portion and an opposite second portion, and the first portion of the second frame extender can be configured to be removably mounted to the second portion of the second coupler. A third frame extender can have a first portion and an opposite second portion, and the first portion of the third frame extender can be configured to be removably mounted to the second portion of the third coupler. A fourth frame extender can have a first portion and an opposite second portion, and the first portion of the fourth frame extender can be configured to be removably mounted to the second portion of the fourth coupler.

The example modular weight stations can include additional couplers for attaching additional support columns. For example, a fifth coupler can have a first portion and an opposite second portion, and the first portion of the fifth coupler can be configured to be removably mounted to the second portion of the first frame extender. A sixth coupler can have a first portion and an opposite second portion, and the first portion of the sixth coupler can be configured to be removably mounted to the second portion of the second frame extender. A seventh coupler can have a first portion and an opposite second portion, and the first portion of the seventh coupler can be configured to be removably mounted to the second portion of the third frame extender. An eighth coupler can have a first portion and an opposite second portion, the first portion of the eighth coupler being configured to be removably mounted to the second portion of the fourth frame extender. A third support column can have a lower receiver and an upper receiver. The lower receiver of the third support column can be configured to be removably mounted to the second portion of the fifth coupler, and the upper receiver of the third support column can be configured to be removably mounted to the second portion of the sixth coupler. A fourth support column can have a lower receiver and an upper receiver. The lower receiver of the fourth support column can be configured to be removably mounted to the second portion of the seventh coupler, and the upper receiver of the fourth support column can be configured to be removably mounted to the second portion of the eighth coupler. A third transverse member can be configured to be removably coupled between the third support column and the fourth support column.

In the example configurations, a first coupler can have a first portion and an opposite second portion. The first portion of the first coupler can be configured to be removably mounted to at least one receiver of the first set of receivers, and the second portion of the first coupler being configured to be removably mounted to an additional structural component. The first portion of the first coupler can include a closed-end of the first coupler, the closed-end being disposed to close an open end of the at least one receiver of the first set of receivers when the first coupler is mounted to the at least one receiver of the first set of receivers.

In example modular weight stations, the at least one of the first set of receivers can define a set apertures, and the first portion of the first coupler can also define a set of apertures. The set of apertures of the first coupler can align with the set of apertures of the at least one receiver of the first set of receivers when the first coupler is mounted to the at least one of the first set of receivers. The set of apertures of the first portion of the first coupler can each be aligned with a respective thread set of the first portion of the first coupler, and the thread sets can be configured to engage a threaded fastener.

The second portion of the first coupler can also define a set of apertures. Each aperture of the set of apertures of the first portion of the first coupler can be spaced apart from one another a first distance. Each aperture of the set of apertures of the second portion of the first coupler are spaced apart from one another a second distance. The first distance can be different than the second distance. The set of apertures of the second portion of the first coupler can each be aligned with a respective thread set of the second portion of the first coupler.

Example modular weight stations can additionally include a frame extender having a first portion and an opposite second portion. The first portion of the frame extender can be configured to be removably mounted to the second portion of the first coupler and can define a set of elongated apertures. The second portion of the first coupler can define a set of apertures. The set of elongated apertures of the first portion of the frame extender can be aligned with the set of apertures defined by the second portion of the first coupler, when the first portion of the frame extender is mounted to the second portion of the first coupler. The coupler can define a first cable passage and, optionally, a second cable passage.

In particular example modular weight stations, at least one receiver of the first set of receivers can be an open end of a first section of square tube. The coupler can include a second section of square tube configured to fit into the open end of the first section of square tube. A frame extender can be formed from a third section of square tube having the same cross-sectional specifications as the first section of square tube, and the second section of square tube can be configured to fit into an open end of the third section of square tube.

Example modular weight stations can include many couplers providing various functions (e.g., joining frame structures, capping frame structures and/or receivers, facilitating cable passage, and so on). Advantageously, the many couplers can all be identical, notwithstanding their different functions.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a modular weight station. Example embodiments include a universal core frame, around which multiple configurations can be built and modified. In the following description, numerous specific details are set forth (e.g., material types, fastening means, etc.) in order to provide a thorough understanding of the invention. Those skilled in the art will recognize, however, that the invention may be practiced apart from these specific details. In other instances, details of well-known manufacturing practices (e.g., metal stock manufacturing, metal cutting, routine optimization, etc.) and components have been omitted, so as not to unnecessarily obscure the present invention.

Figure 1:
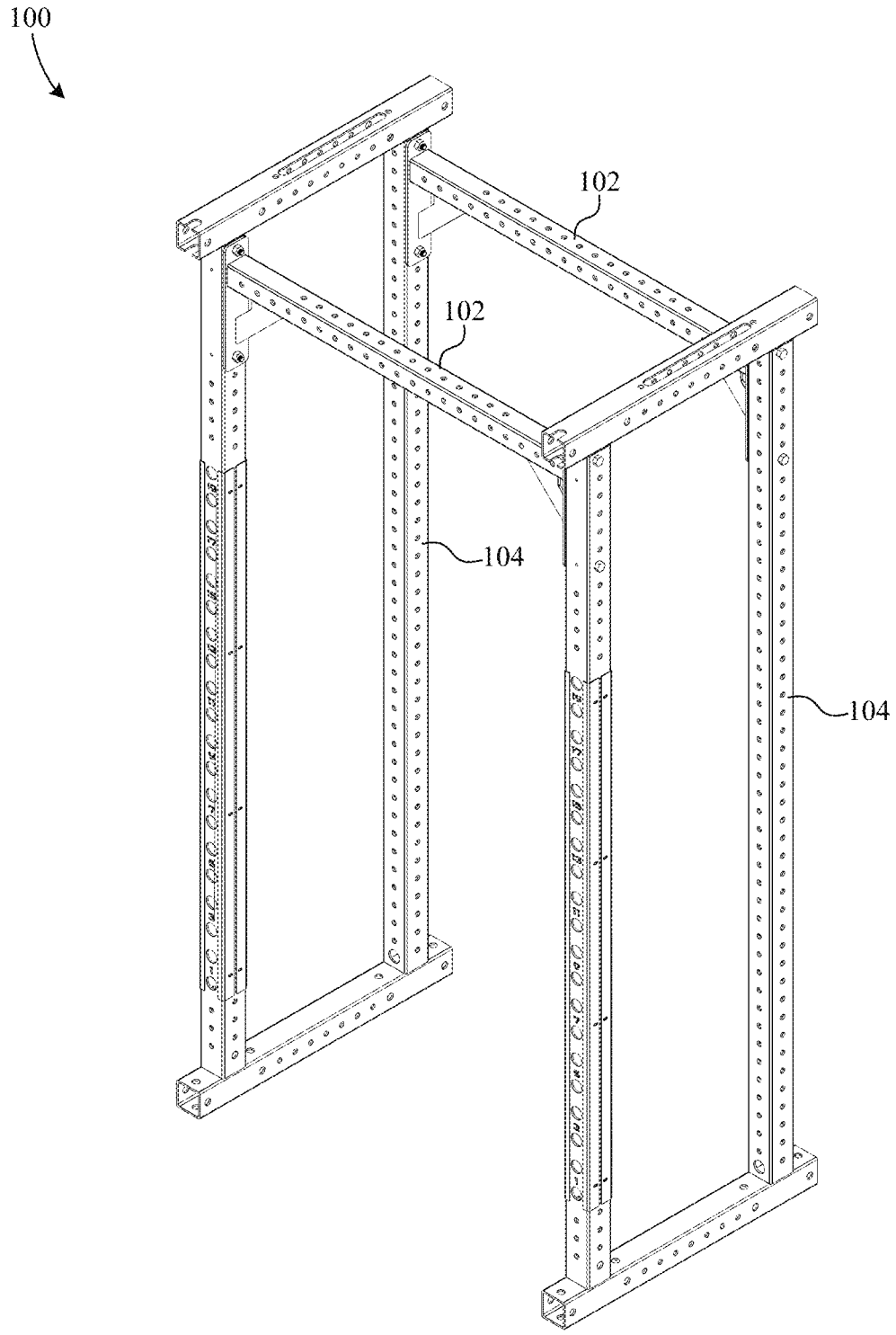
FIG. 1 is a perspective view of a frame of a modular weight station.

FIG. 1 shows a perspective view of a central frame 100 of a modular workout station. Frame 100 is adapted to support various modular components that may be attached thereto in various different configurations. The modularity of frame 100 allows it to be easily transformed into different types of exercise equipment by simply adding and/or removing components. For example, frame 100 may be converted into a cable weight station by mounting modular cable weight components thereto. If, for example, a gym owner decides to convert the cable weight station into a free weight station, the owner may remove the cable weight components from frame 100 and then attach free weight components (e.g., spotter arms, weight horns, etc.) to frame 100. Optionally, a mix of different types of components may be attached to frame 100 according personal preference. For example, the user may decide to attach free weight components to one side of frame 100 and cable weight components to the other side of frame 100. An advantage of the modularity of frame 100, is that there is no longer a need to remove and replace old equipment entirely. Rather, a gym owner may simply convert frame 100 into a completely different machine. Of course, this adaptability is highly desirable to gym owners, because it substantially reduces the cost of introducing new workout options.

Central frame 100 includes two cross supports 102 interposed between two support columns 104. Each cross support 102 includes a first end mechanically fastened (e.g., bolted, cam-locked, and so on) to a first one of support columns 104 and an opposite second end mechanically fastened to the second one of support columns 104. In the example embodiment, the fasteners used to attach cross support 102 and support columns 104 are nut and bolt assemblies.

Figure 2:
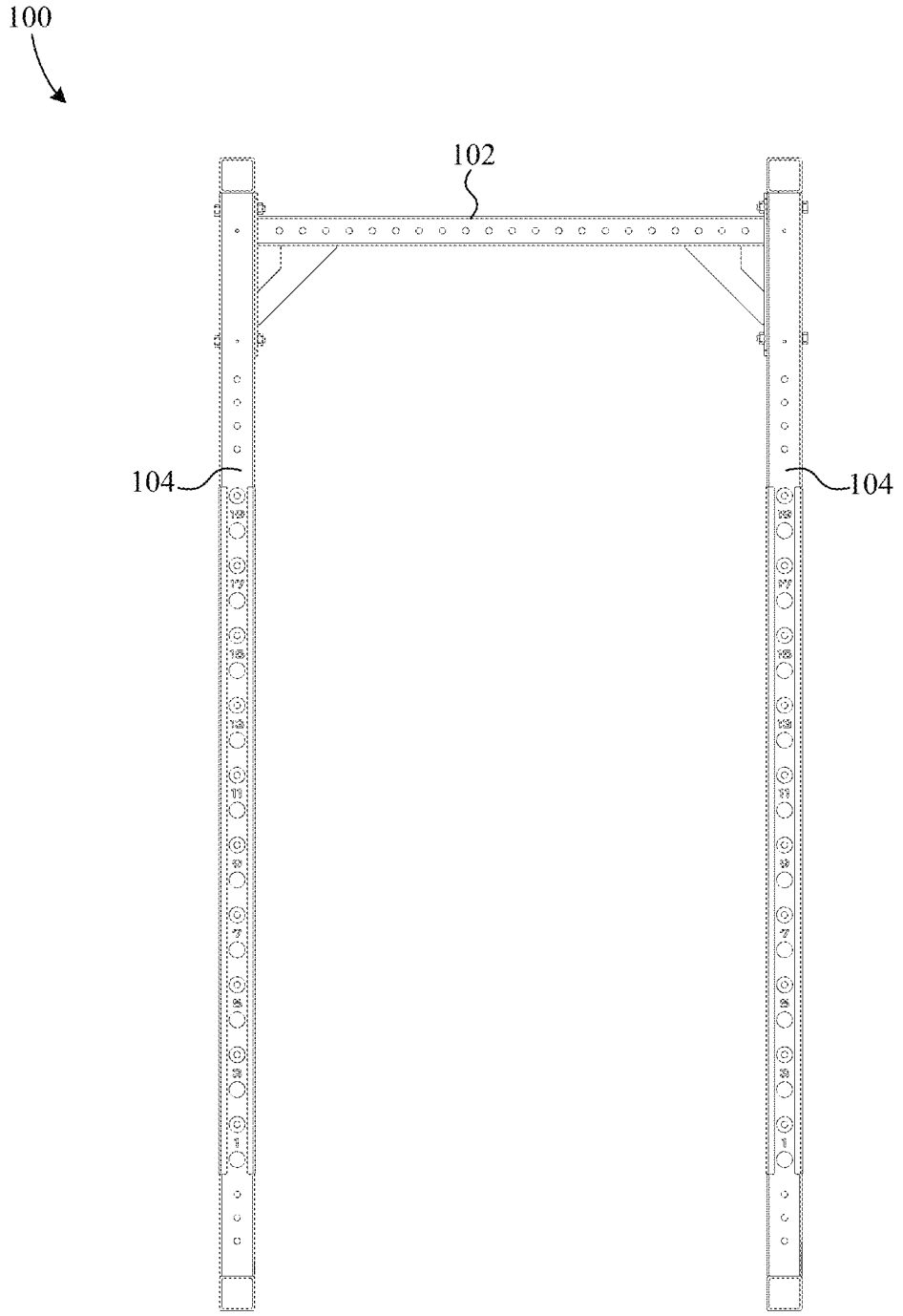
FIG. 2 is front plan view of the frame of FIG. 1.

FIG. 2 is a front plan view of central frame 100. As shown, support columns 104 are disposed parallel to one another. Likewise, cross support 102 are disposed parallel to one another.

Figure 3:
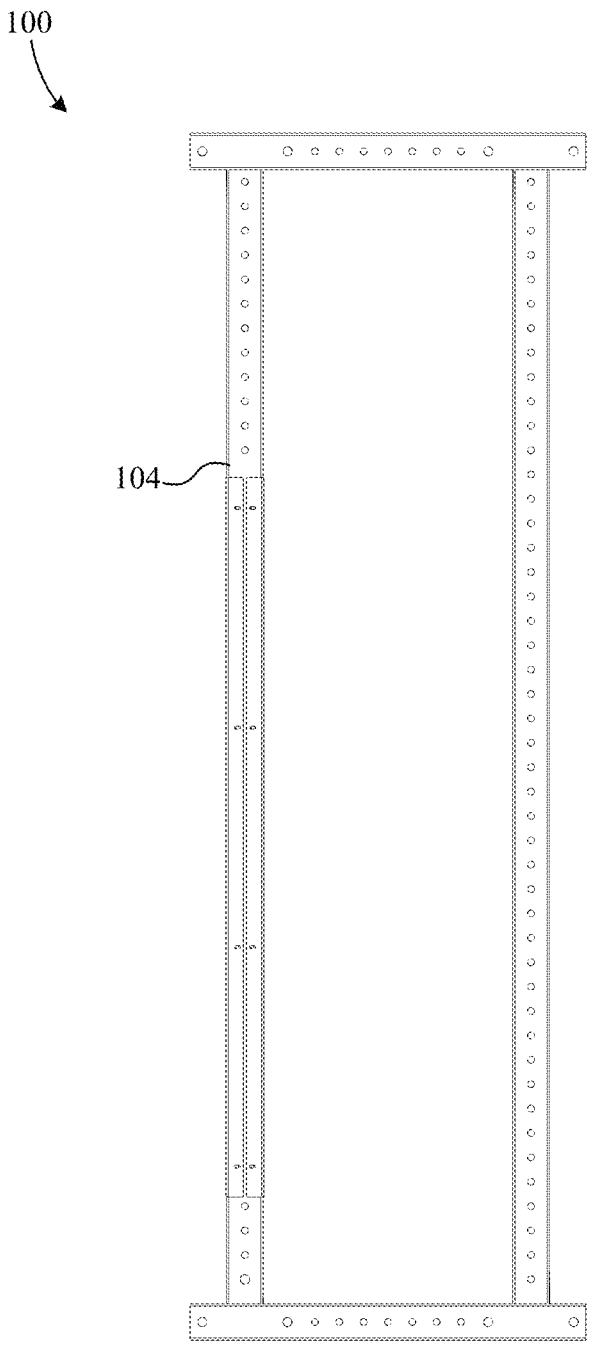
FIG. 3 is a side plan view of the frame of FIG. 1.

FIG. 3 is a side plan view of central frame 100. When assembled, frame 100 is a single rigid body structure.

Figure 4:
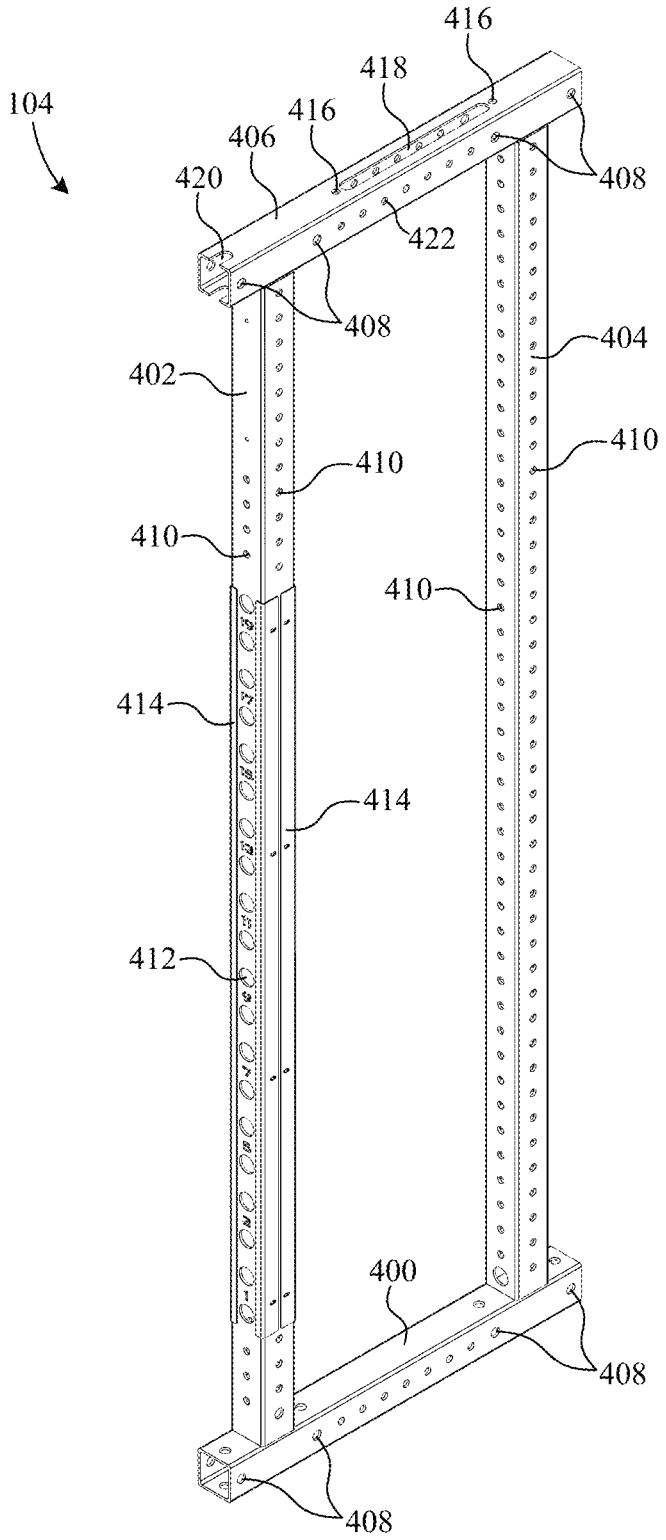
FIG. 4 is a perspective view of a side structure of the frame of FIG. 1.

FIG. 4 is a perspective view of one of the two support columns 104 of frame 100. Support column 104 includes a base member 400, a first column 402, a second column 404, and a top member 406. The bottom ends of columns 402 and 404 are fixed (e.g. welded, mechanically fastened, and so on) to the top of base member 400, while the top ends of columns 402 and 404 are fixed (e.g. welded, mechanically fastened, and so on) to the bottom of top member 406. Each of base member 400, first column 402, second column 404, and top member 406 are formed from a section of steel square stock defining a plurality of apertures (e.g., holes, channels, notches, etc.).

Base member 400 provides support to frame 100 and facilitates the attachment of various modular components (e.g., frame extenders, frame legs, cable weight components, etc.) to frame 100. Each of the two open ends of base member 400 functions as a receiver configured to receive a universal coupler (described below with reference to FIG. 6) that attaches frame 100 to modular frame components. Further, each open end of base member 400 is accompanied by a respective set of two apertures 408 that pass completely through base member 400. Each set of two apertures 408 is configured to receive a respective set of two bolts that are used to attach a coupler to base member 400.

Column 402 provides vertical support to frame 100 and components loaded thereon. Column 402 includes a plurality of small holes 410, a plurality of large, numbered holes 412, and a set of guards 414. Small holes 410 are formed completely through the sidewalls of column 402 and are configured to receive bolts that facilitate the attachment of various modular components to column 402. Large holes 412 are configured to selectively receive a peg of spotter arms, J-cup bar supports, etc. Further, large holes 412 are numbered so that a returning user can quickly identify a particular height at which they wish to mount a spotter arm, J-cup bar support, etc. Guards 414 can be fastened to column 402 by, for example, screws or any other suitable means. Guards 414 protect column 402 from being damaged by weight bars, weights, etc. Column 404 also provides vertical support to frame 100 and components loaded thereon.

Column 404 includes a plurality of small holes 410 that are formed completely through the sidewalls of column 402 and are configured to receive bolts that facilitate the attachment of various modular components to column 404.

Top member 406 provides support to frame 100 and facilitates the attachment of various modular components (e.g., frame extenders, frame legs, cable weight components, etc.) to frame 100. Each of the two open ends of top member 406 functions as a receiver configured to receive a universal coupler that attaches frame 100 to modular frame components. Further, each open end of top member 406 is accompanied by a respective set of two apertures 408 that pass completely through top member 406. Each set of two apertures 408 of top member 406 is configured to receive a respective set of two bolts that are used to attach a coupler to base member 400. Top member 406 further includes a set of small apertures 416, a first cable passage 418, a second cable passage 420, and a set of apertures 422. Apertures 416 are configured to receive bolts used to fasten modular cable pulley assemblies to top member 406. Cable passage 418 is an elongated opening that passes completely through top and bottom sidewalls of top member 406 to allow weight cables to pass and move through top member 406 without obstruction. Similarly, cable passage 420 is an opening that passes completely through the top and bottom sidewalls of top member 406 to allow weight cables to pass and move through an open end of top member 406 without obstruction. Apertures 422 extend horizontally through top member 406 and are configured to receive bolts of modular components mounted to the side of top member 406.

In the example embodiment, the spacing between each set of two apertures 408 is identical and the internal dimensions of each open end of base member 400 and top member 406 are the same. Accordingly, a single universal coupler can be mounted in an open end of base member 400, removed, and then mounted in an open end of top member 406. Similarly, each of two identical universal couplers can be mounted in a respective one of the open ends of base member 400 and top member 406.

Figure 5:
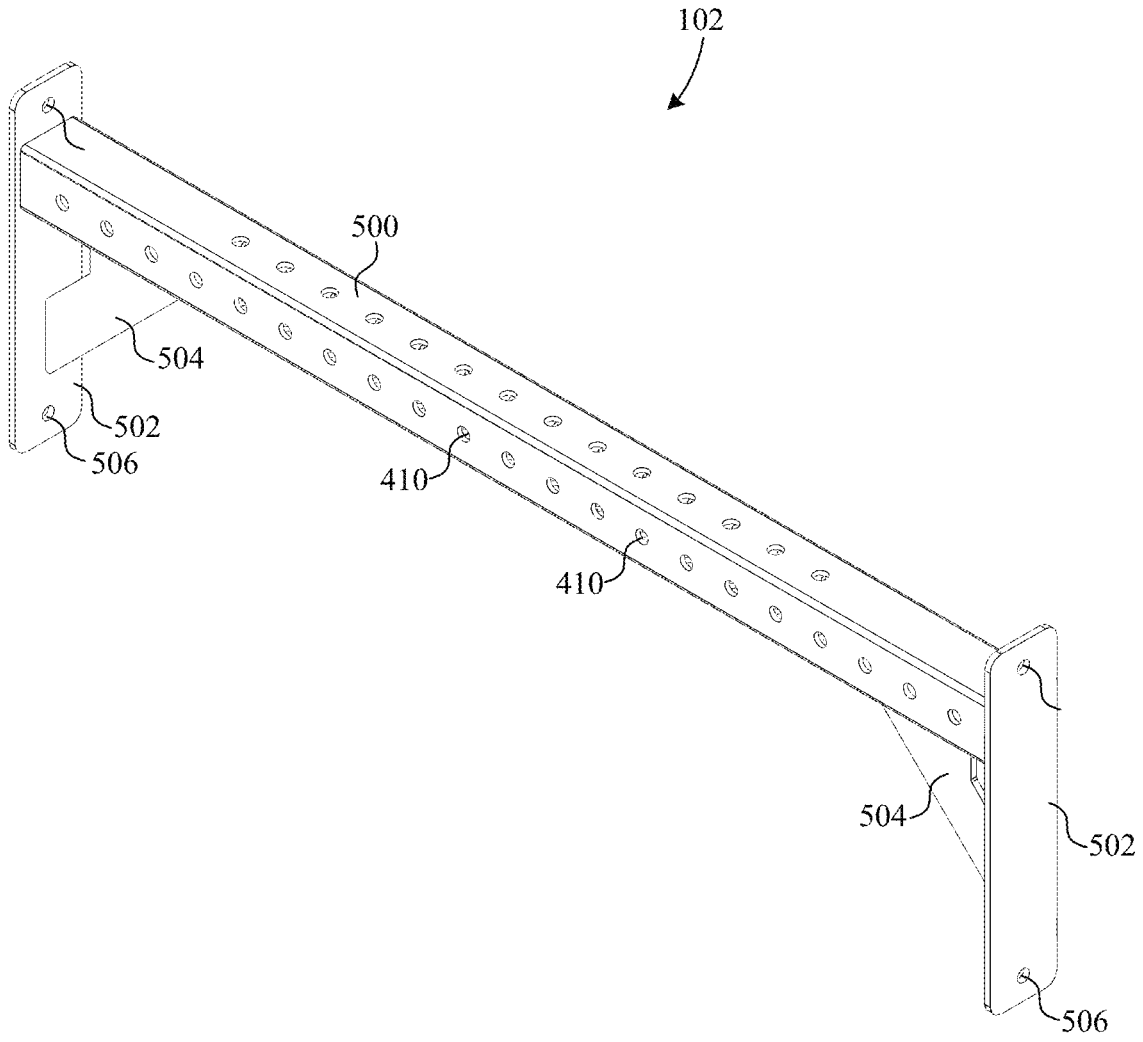
FIG. 5 is a perspective view of a cross-member of the frame of FIG. 1.

FIG. 5 shows a perspective view of one of cross supports 102 removed from frame 100. Cross support 102 is configured to provide support between support columns 104 and also support modular components such as, by way of non-limiting example, chin-up bars, cable weight components, etc. Cross support 102 includes a beam 500, two flange plates 502, and two support plates 504. Beam 500 is a section of steal square stock defining a plurality of holes 410 that are configured to receive bolts used to mount various modular components to cross support 102. Holes 410 are formed through the top surface, bottom surface, and each side surface of beam 500. Each of flange plates 502 is welded to a respective end of beam 500 to facilitate the mounting of cross support 102 to support columns 104. Each of flange plates 502 defines a set of holes 506 that receive the bolts used to mount cross support 102 to support column 104. Accordingly, the spacing between holes 506 is an integer multiple of the spacing between holes 410 of support columns 104. Each of support plates 504 is welded between a respective one of flange plates 502 and a respective end of beam 500 to provide additional structural support therebetween.

Figure 6:
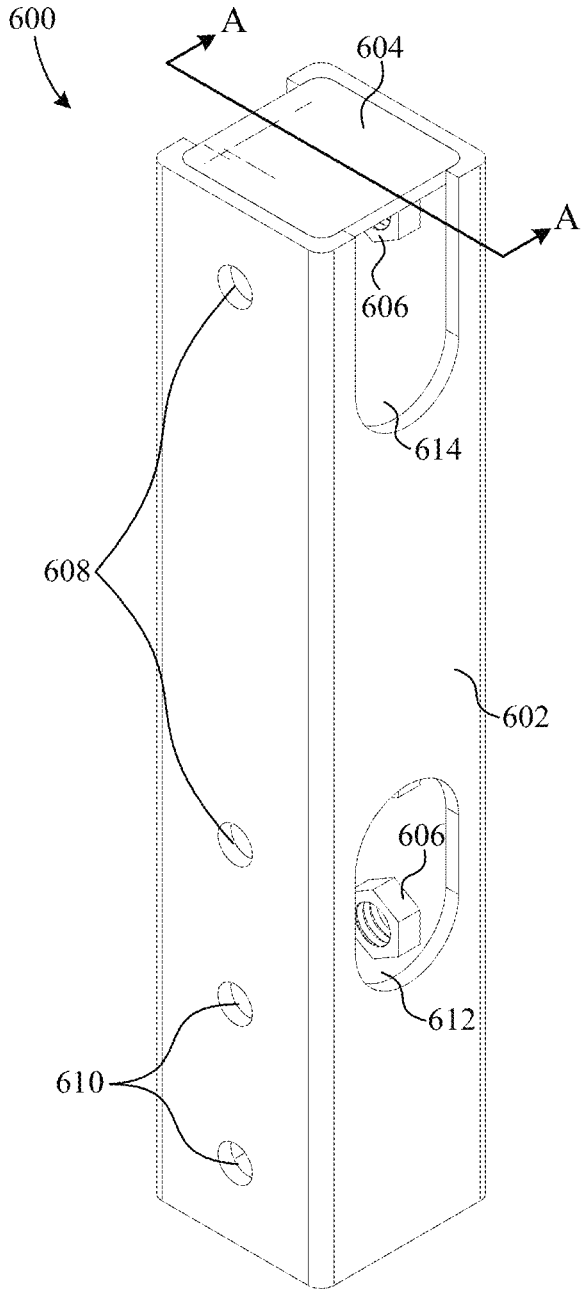
FIG. 6 is a perspective view of a coupler.

FIG. 6 is a perspective view of a universal coupler 600 that facilitates the mounting of various components to any of the receivers of frame 100. Coupler 600 is configured to be inserted and mounted into the open ends of base member 400 and top member 406. Coupler 600 may be mounted entirely or partially within an open end. When coupler 600 is mounted entirely in an open end, it may function to close the otherwise open end. When coupler 600 is mounted partially in an open end, it may be used to couple additional components to frame 100. That is, when coupler 600 is mounted partially in an open end, the remaining portion of coupler 600 may protrude from the open end and be mounted in another open end of a modular component such as, for example, a frame extender.

Coupler 600 includes a body 602, an end plate 604, and four weld nuts 606, only two of which are visible in the view of FIG. 6. Body 602 defines a first set of two holes 608, a second set of two holes 610, a first cable passage 612, and a second cable passage 614. Holes 608 are spaced such that they coaxially align with respective holes 408 (of base member 400 or top member 406) when coupler 600 is inserted into an open end of frame 100. Once aligned, bolts may be inserted through holes 408 of frame 100 and holes 608 of coupler 600 simultaneously, thereby mounting coupler 600 to frame 100. Holes 610 are configured to be aligned with a complementary set of holes of a modular component including, but not limited to, a frame extender. Of course, once holes 610 are aligned with holes of a modular component, a set of respective set of bolts may be disposed therethrough to fix coupler 600 to the modular component. The first two of the four weld nuts are coaxially aligned with holes 608 and welded to the interior wall of body 602, and the second two of the four weld nuts 606 are coaxially aligned with holes 610 and also welded to the interior wall of body 602. Cable passage 612 passes completely through the middle region of coupler 600 to optionally allow a weigh cable to move freely therethrough without obstruction. Likewise, cable passage 614 passes completely through an end region of coupler 600 to allow a weight cable to move freely therethrough without obstruction. End plate 604 is welded into body 602 such that flat top planar surface of end plate 604 is flush with the planar top end of body 602. Plate 604 functions to optionally close an otherwise open end of frame 100 when coupler 600 is inserted therein, providing a more finished appearance. Indeed, coupler 600 may be used to couple components to frame 100 and/or function to simply close an otherwise open end of frame 100.

Figure 7:
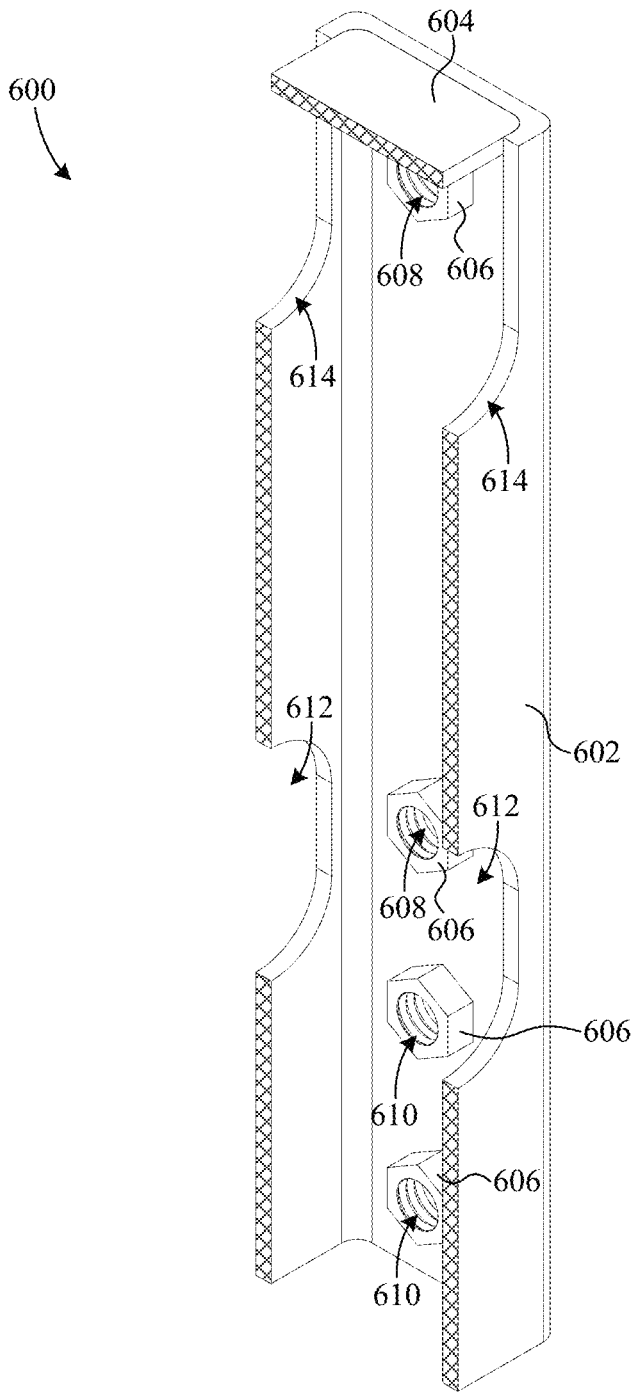
FIG. 7 is a perspective view of the coupler of FIG. 6 sectioned along line A-A of FIG. 6.

FIG. 7 is another perspective view of universal coupler 600 sectioned along line A-A of FIG. 6. As shown, the end of body 602 opposite end plate 604 is open. Also shown are the four weld nuts 606 welded to the interior wall of body 602 and aligned with apertures 608 and 610, such that bolts can be passed through the sidewall of coupler 600 to engage the threads of weld nuts 606. The functionality of weld nuts 606 will be described in further detail below with reference FIGS. 16A-C and FIG. 17.

Figure 8:
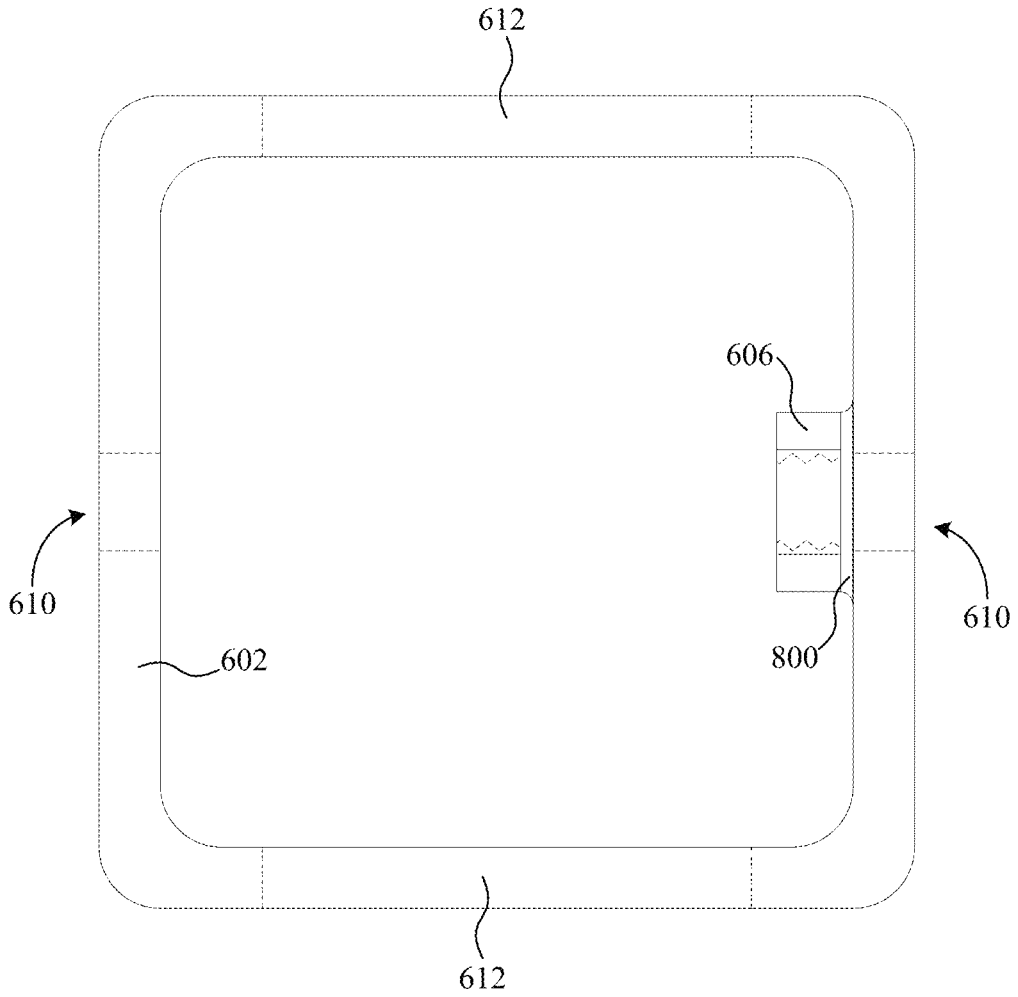
FIG. 8 is a bottom plan view of the coupler of FIG. 6.

FIG. 8 shows a bottom view of universal coupler 600. As shown, all four of weld nuts 606 are attached to the same interior sidewall of coupler 600 by a weld joint 800 and aligned in a column configuration. Optionally, an additional column of four weld nuts 606 may be welded to the opposing interior sidewall of coupler 600.

Figure 9:
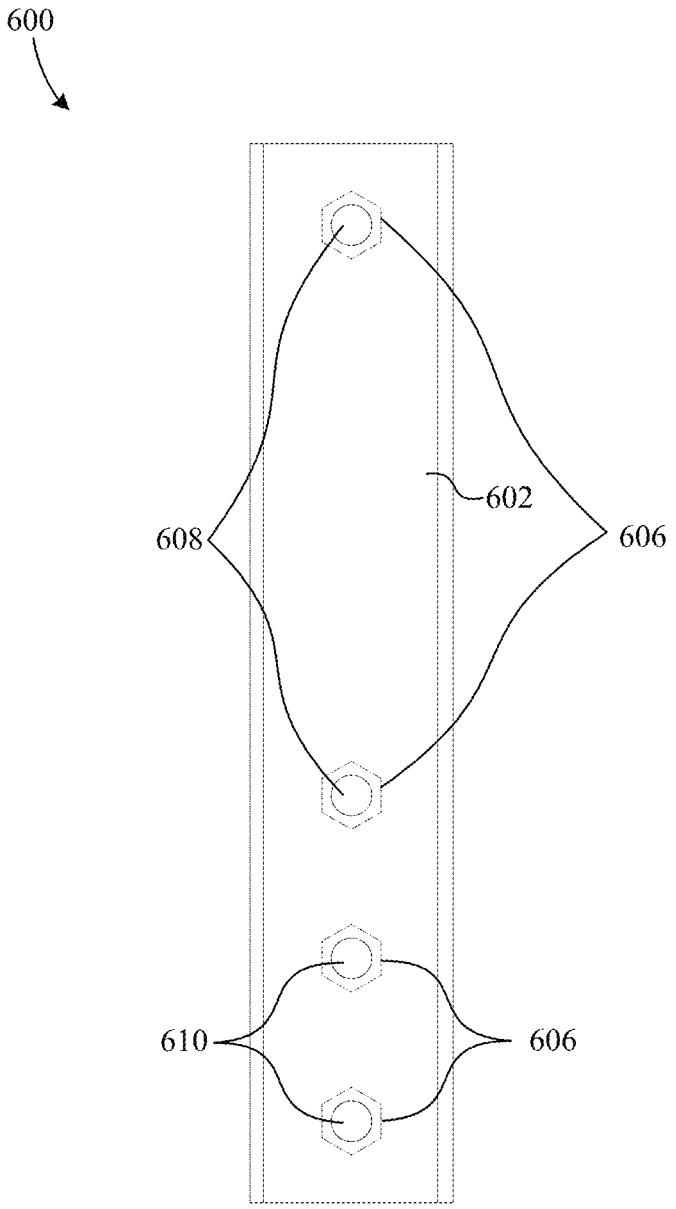
FIG. 9 is a side plan view of the coupler of FIG. 6.

FIG. 9 is a first side plan view of universal coupler 600. In the view of FIG. 9, weld nuts 606 are shown in phantom lines, in alignment with holes 608 and 610.

Figure 10:
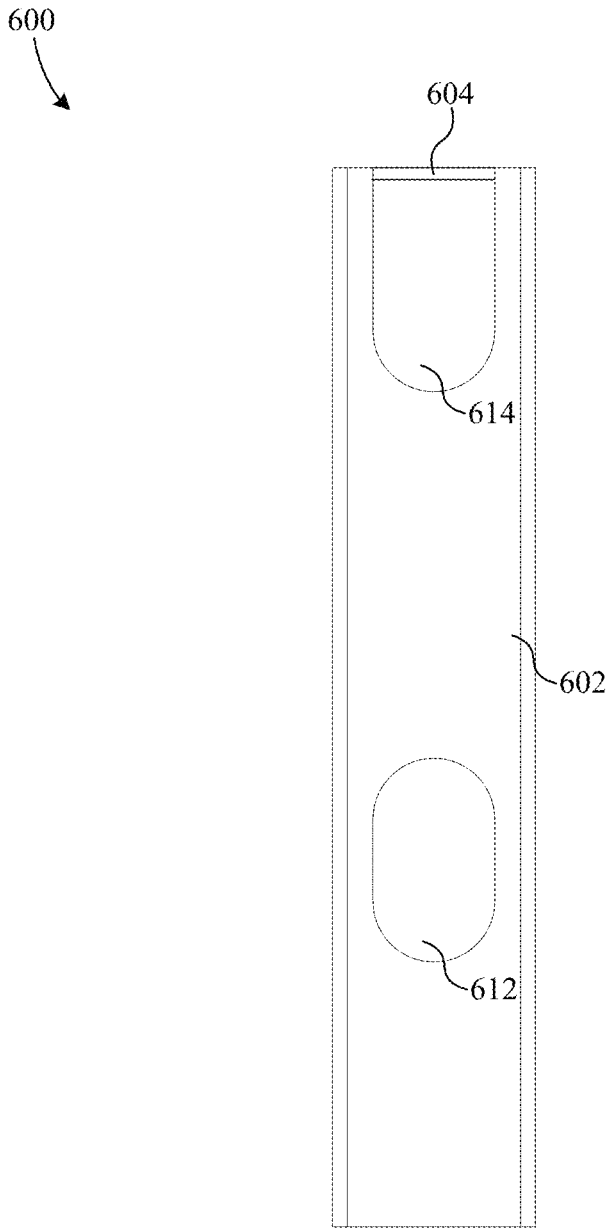
FIG. 10 is another side plan view of the coupler of FIG. 6.

FIG. 10 is a second side plan view of universal coupler 600.

Figure 11:
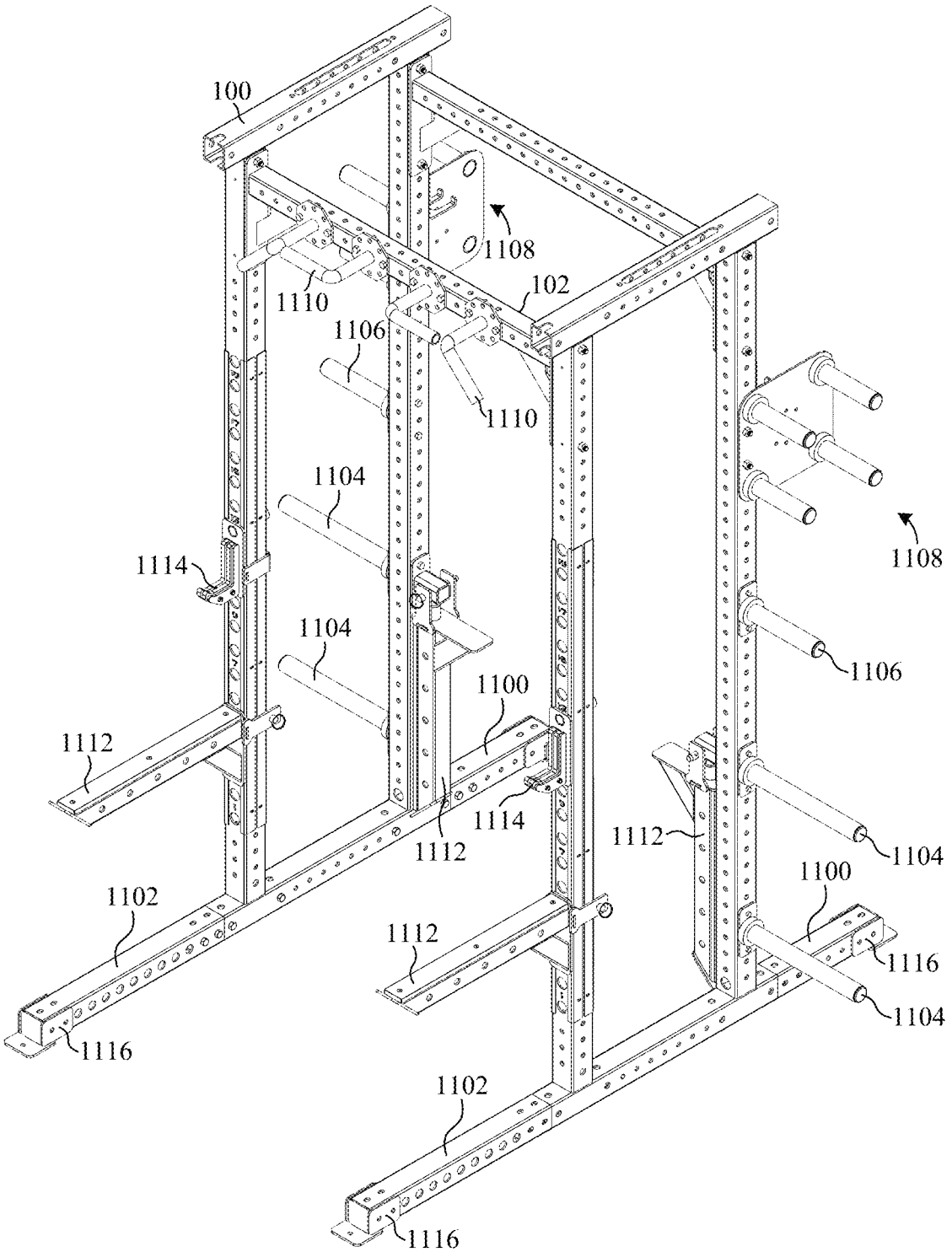
FIG. 11 is a perspective view of the frame of FIG. 1 having various modular components coupled thereto according to one example configuration.

FIG. 11 is a perspective view of frame 100 having various modular components attached thereto. In this first example configuration, the various modular components include two short frame extenders 1100, two long frame legs 1102, a plurality of long weight horns 1104, a plurality of short weight horns 1106, a plurality of weight horn assemblies 1108, a plurality of pull-up handles 1110, a plurality of spotter arms 1112, and a plurality of J-cup bar supports 1114.

Frame legs 1100 and 1102 are attached to frame 100 to increase the overall footprint size of frame 100 and, thereby, add stability to frame 100. One end of each leg 1100 and 1102 is attached to frame 100 by a respective coupler 600 (not visible). The other end of each frame leg 1100 and 1102 is bolted to a respective foot structure 1116. Foot structures 1116, together, elevate frame 100 slightly off the underlying surface to prevent frame 100 from rocking on an uneven surface, by limiting the contact between frame 100 and the underlying surface to four discrete points of contact. Once a weight load is applied to frame 100, frame 100 can settle to provide additional points of contact with the supporting surface, thereby increasing the stability of frame 100 even further. In this non-limiting example, frame legs 1100 and 1102 are formed from sections of steel square stock.

Weight horns 1104 and 1106 are bolted to columns 404 of frame 100 and are configured to support annular free-weights. Likewise, weight horn assemblies 1108 are bolted to columns 404 of frame 100 and are configured to support annular free-weights.

Pull-up handles 1110 are bolted to one of cross supports 102 of frame 100 and are configured to support a user hanging therefrom. As shown, the two outside pull-up handles 1110 are orientated to point slightly downward at a forty-five degree angle and the two inside pull-up handles 1110 are orientated to point horizontally. Optionally, pull-up handles 1110 may be bolted to frame 100 at any desired orientation, at forty-five degree angle increments.

Two of spotter arms 1112 are adjustably coupled to column 402 to support a weight bar at various heights. The height of the two spotter arms 1112 may adjusted by lifting them to a desired numbered hole 412. As the user releases them, a peg located on each respective spotter arm 1112 is inserted in a numbered hole 412 and locks into place wherein it can support substantial weight loaded thereon. The other two spotter arms 1112 are coupled to frame 100 via a respective set of flange mounts 1118 that are bolted to frame 100. When mounted to frame 100 by flange mounts 1118, spotter arms 1112 can function as steps.

J-cup bar supports 1114 are adjustably coupled to column 402 to support a weight bar at various heights. The height of J-cup bar supports 1114 may adjusted by lifting them to a desired numbered hole 412. As the user releases them, a peg located on each respective J-cup bar supports 1114 is inserted in a numbered hole 412 and locks into place wherein it can support substantial weight loaded thercon.

Figure 12:
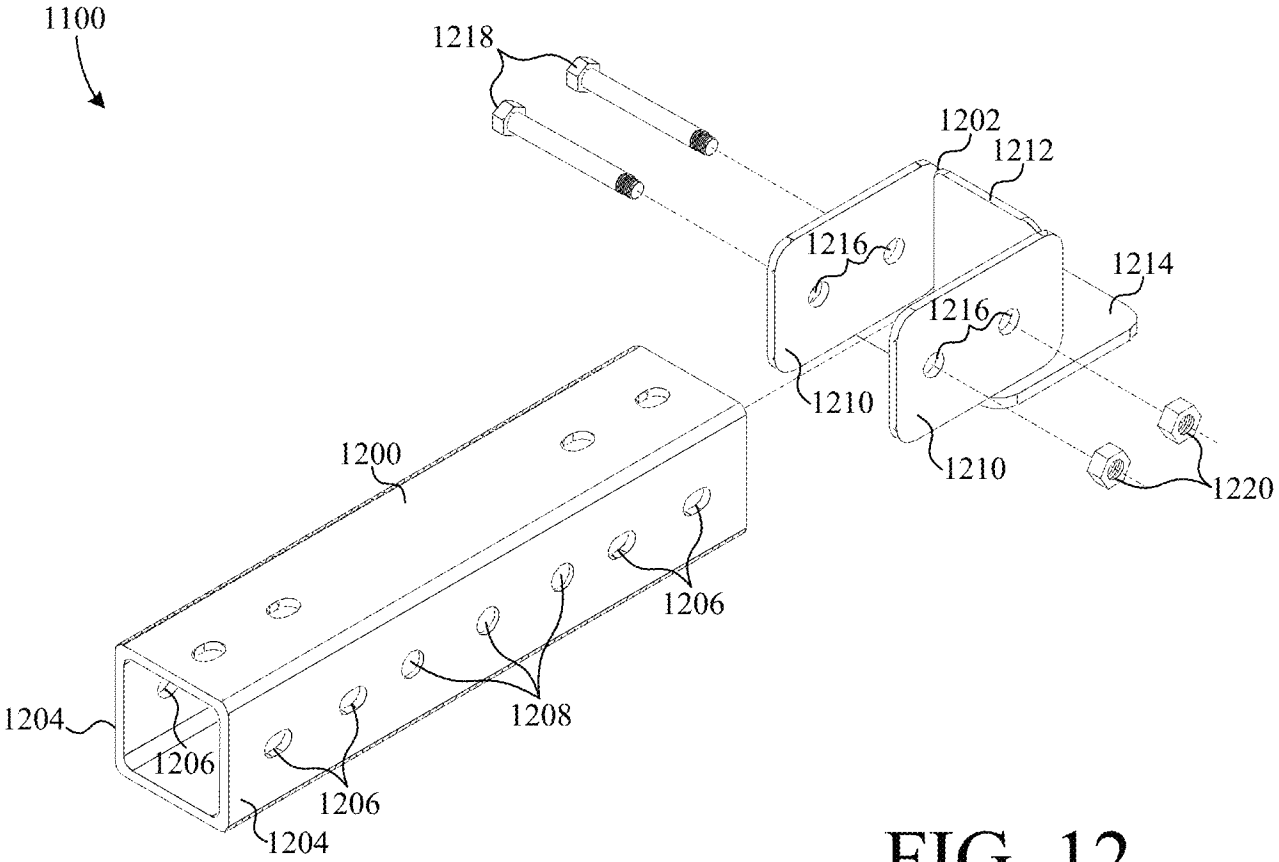
FIG. 12 is an exploded perspective view of one of the frame legs of FIG. 11.

FIG. 12 shows an exploded perspective view of one of short frame legs 1100, which includes a frame extender 1200 and a foot structure 1202. Frame extender 1200 is configured to be mounted to frame 100 by a respective coupler 600 and is formed from a section of steal square stock having the same cross-sectional specifications as that of the square stock used to form frame 100. Frame extender 1200 includes two opposing sidewalls 1204, each defining four slots 1206 and three holes 1208. Although not entirely visible, the four slots 1206 of the first sidewall are aligned with the four slots 1206 on the opposing sidewall, such that each aligned pair of slots is adapted to receive a respective bolt disposed therethrough. The elongation of slots 1206 allows the position of frame extender 1200 with respect to the bolts to be adjusted slightly before the bolts are tightened. The spacing between each pair of slots 1206 is selected so that slots 1206 can be aligned with a respective pair of apertures 610 of coupler 600.

Foot structure 1202 is configured to mount to an open end of frame extender 1200 to provide added stability to frame 100. Foot structure 1202 includes two sidewalls 1210, an intermediate wall 1212, and a bottom wall 1214. Each of the two sidewalls 1210 define a pair of bolt holes 1216 that align with slots 1206 to facilitate the attachment of foot structure 1202 to frame extender 1200 by a set of bolts 1218 and nuts 1220. When assembled, each bolt 1218 is simultaneously disposed through two of bolt holes 1216 and two of slots 1206. Each bolt 1218 is then held in place by a respective one of nuts 1220 threaded thereon. Intermediate wall 1212 is fixed between sidewalls 1210 and bottom wall 1214 and closes off the otherwise open end of frame extender 1200.

Bottom wall 1218 is configured to abut the bottom surface of frame extender 1200 so as to slightly elevate at least a portion of the bottom surface of frame extender 1200 off of the ground.

Figure 13:
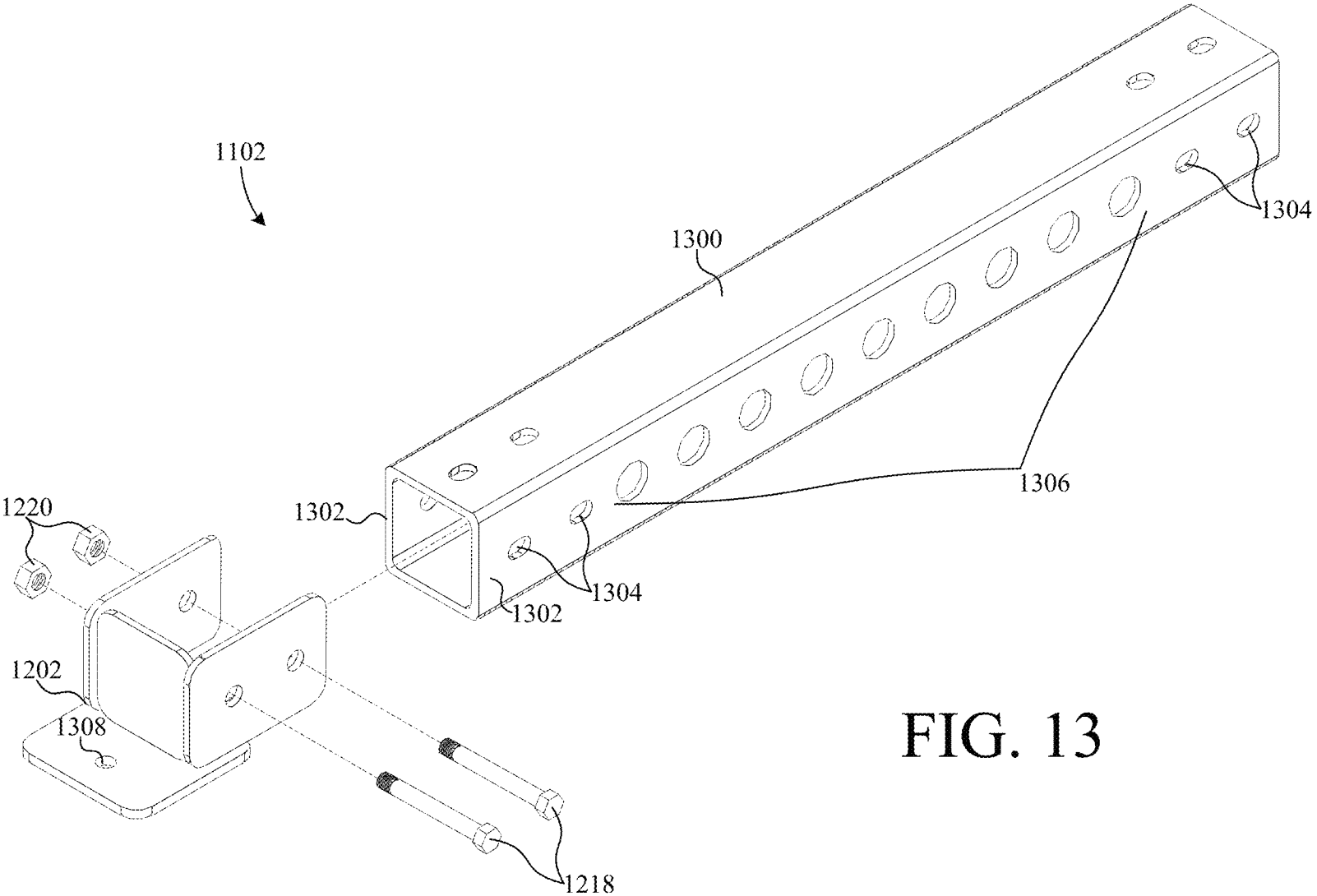
FIG. 13 is an exploded perspective view of another one of the frame legs of FIG. 11.

FIG. 13 shows an exploded perspective view of one of long frame legs 1102, which includes a frame extender 1300 and a foot structure 1202. Frame extender 1300 is configured to be mounted to frame 100 by a respective coupler 600 and is formed from a section of steal square stock having the same cross-sectional specifications as that of the square stock used to form frame 100. Frame extender 1300 includes two opposing sidewalls 1302, each defining four slots 1304 and a plurality of holes 1306 disposed therebetween. Although not entirely visible, the four slots 1304 of the first sidewall are aligned with the four slots 1304 on the opposing sidewall such that each aligned pair of slots is adapted to receive a respective bolt disposed therethrough. The elongation of slots 1304 allows the position of frame extender 1300 with respect to the bolts to be adjusted slightly before the bolts are tightened. Note that the spacing between each pair of slots 1304 is selected to facilitate alignment with a respective pair of apertures 610 of coupler 600. Frame extender 1300 is similar to frame extender 1200 but is longer. Foot structure 1202 is mounted to frame extender 1300 via bolts 1218 and nuts 1220 and provides the same function as that described with reference to FIG. 12. As shown, bottom wall 1214 of foot structure 1202 also defines an aperture 1308, which provides the option to receive a bolt for bolting frame 100 to an underlying supporting surface such as, for example, a platform, a floor, etc.

Figure 14:
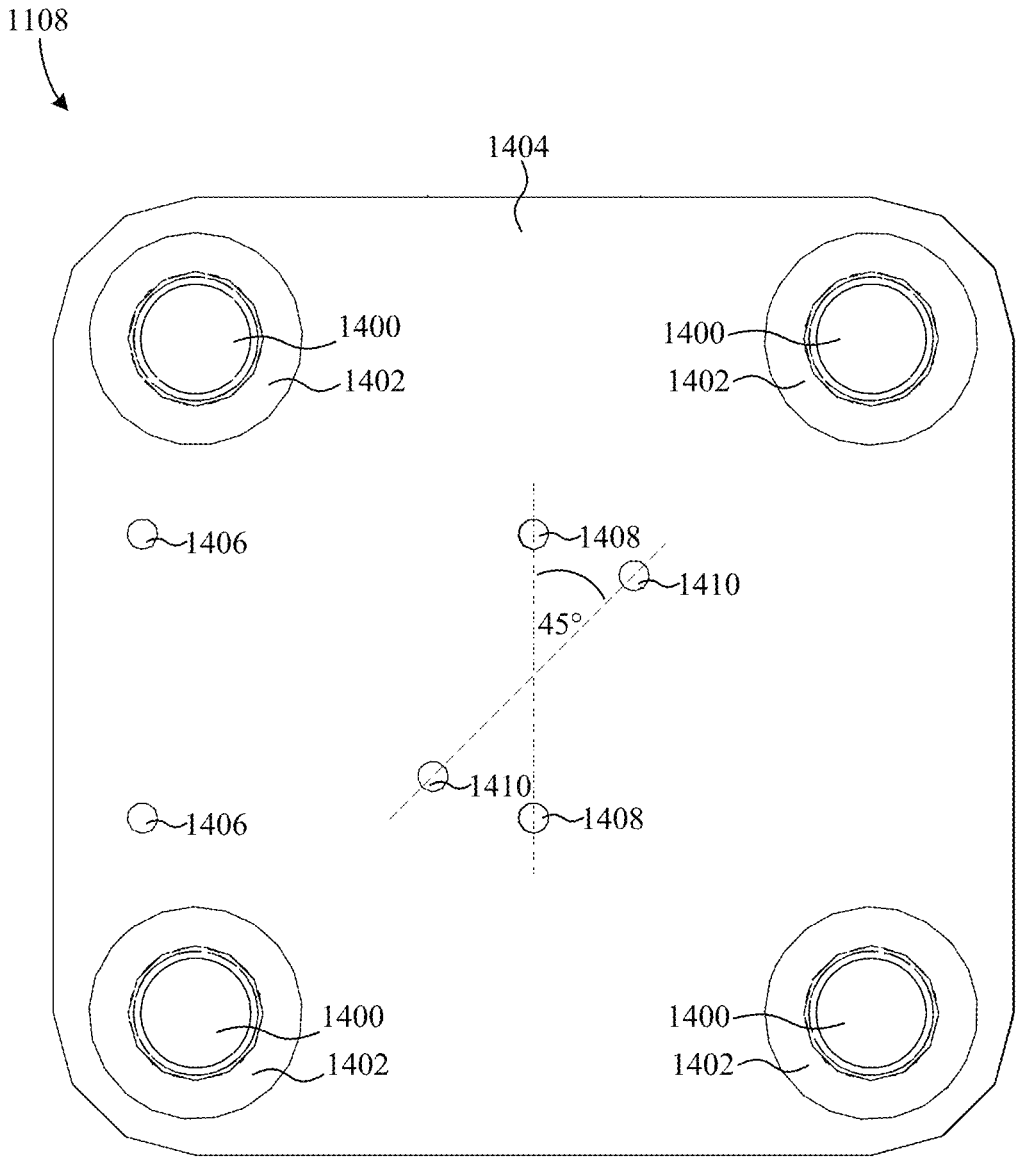
FIG. 14 is a plan view of a weight horn assembly of FIG. 11.

FIG. 14 is a front plan view of weight horn assembly 1108. Weight horn assembly 1108 includes four weight horns 1400, four bumpers 1402, and plate 1404. Each of weight horns 1400 is a cylindrical steel structure that is attached to plate 1404 by, for example, welding. Each of bumpers 1402 is an annular rubber member that is disposed around a respective weight horn 1400 to prevent annular weights stored on weight horns 1400 from being damaged and from damaging weight horn assembly 1108. Plate 1404 is configured to be bolted onto frame 100 in various configurations through a series of apertures. For example, plate 1404 defines a first set of apertures 1406, a second set of apertures 1408, and a third set of apertures 1410. Apertures 1406 are offset to one side of plate 1404 so that weight horn assembly 1108 can extend horizontally to one side of a frame structure (i.e. column 404) when bolted thereto. Apertures 1408 are located in the center of plate 1404 so that weight horn assembly 1108 can optionally be centered with respect to the supporting frame structure to which it is mounted. Apertures 1410 are located within a line that is offset from a line passing through apertures 1408 by forty five degrees so that weight horn assembly 1108 may optionally be mounted at an offset of forty five degrees and centered with respect to the supporting frame structure to which it is mounted. Note that each set of apertures 1406, 1408, and 1410 has the same spacing therebetween. Furthermore, the distance between each two apertures is an integer multiple of the spacing between apertures 410 of column 404.

Figure 15:
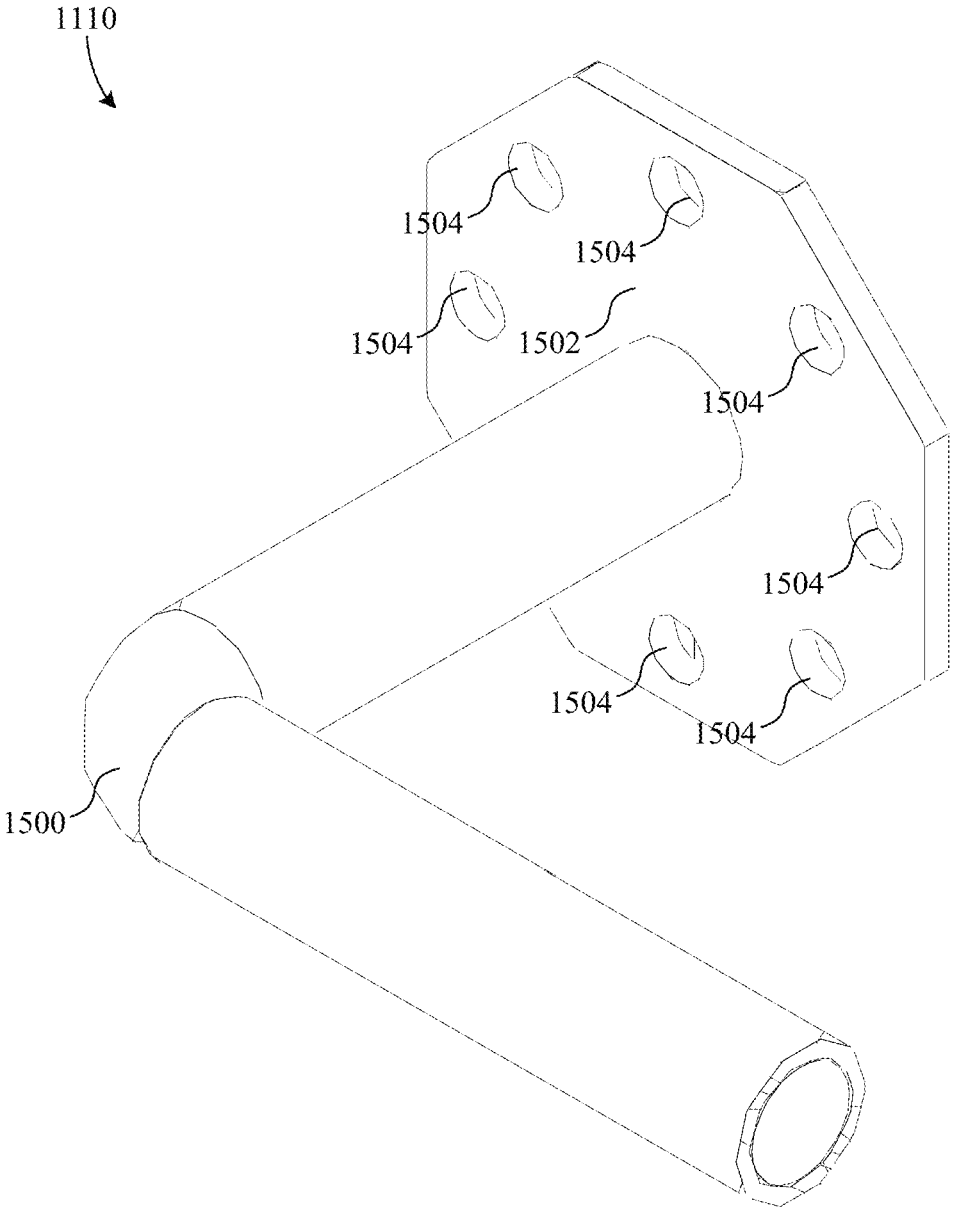
FIG. 15 is a perspective view of a pull-up handle of FIG. 11.

FIG. 15 shows a perspective view of one of chin-up handles 1110 removed from frame 100. Chin-up handle 1110 includes handle portion 1500 welded to a mounting plate 1502. Handle portion 1500 provides a user with a structure to grasp while lifting upward. Handle portion 1500 is formed from a section of steel tube bent at a ninety degree angle. Base plate 1502 includes a plurality of apertures 1504 disposed about handle portion 1500 every forty-five degrees. Each of apertures 1504 is configured to receive a bolt for mounting chin-up handle 1110 to frame 100. Typically, two bolts would be used to mount chin-up handle 1110 to frame 100 and such bolts would be located 180 degrees about handle portion 1500. Because apertures 1504 are disposed forty-five degrees apart, handle portion 1500 may be mounted to point toward 0° (as shown), 45°, 90°, 135°, 180°, 225°, 270°, or 315°. Optionally, any number of apertures may be disposed around handle portion 1500. Note that the distance between two opposing apertures (e.g. aperture at 0° and aperture at 180°) is an integer multiple of the distance between apertures 410 of cross support 102.

Figure 16A:
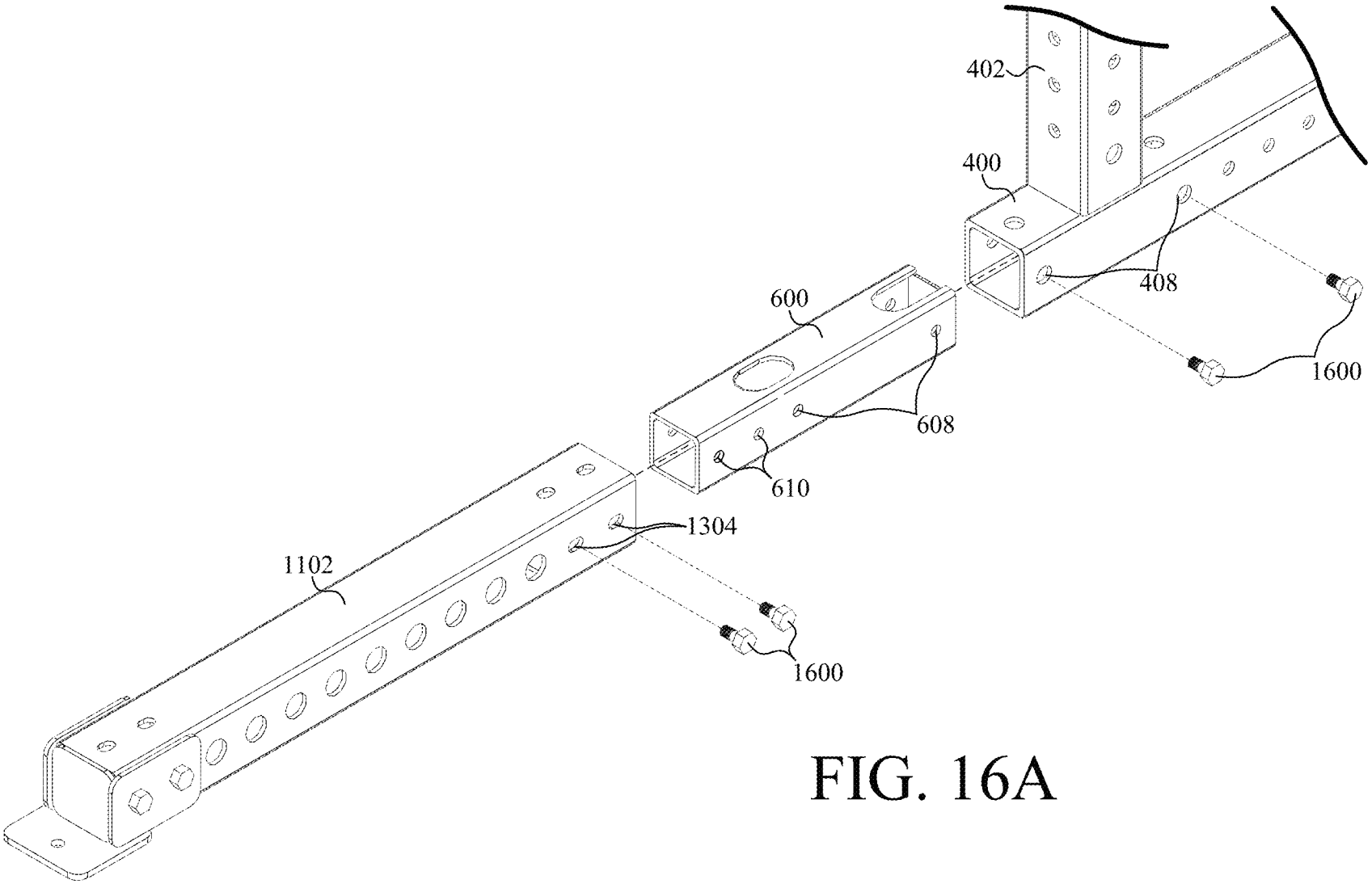
FIG. 16A illustrates a first step of coupling the frame leg of FIG. 12 to the frame of FIG. 1 with the coupler of FIG. 6.
Figure 16B:
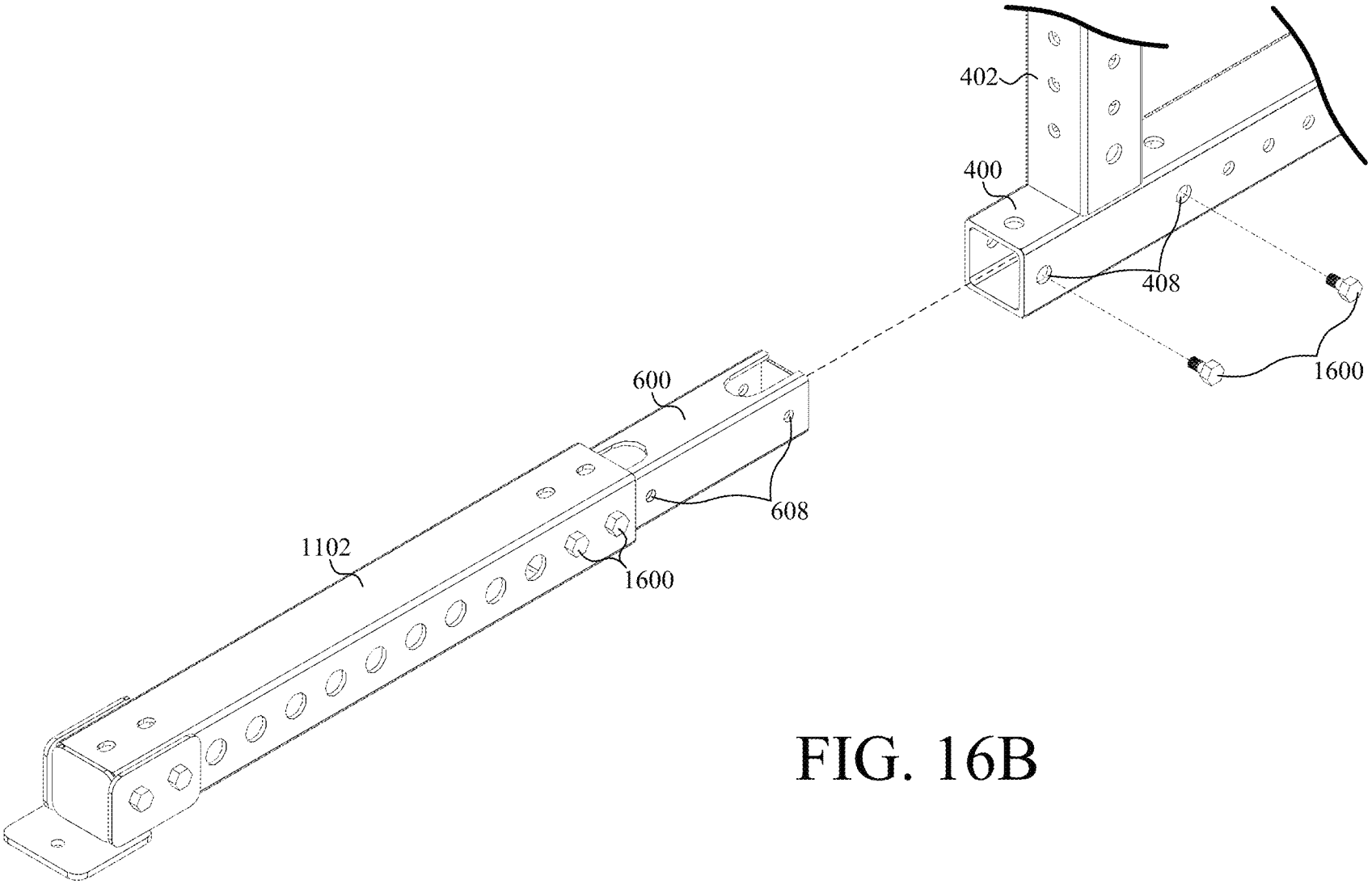
FIG. 16B illustrates a second step of coupling the frame leg of FIG. 12 to the frame of FIG. 1 with the coupler of FIG. 6.
Figure 16C:
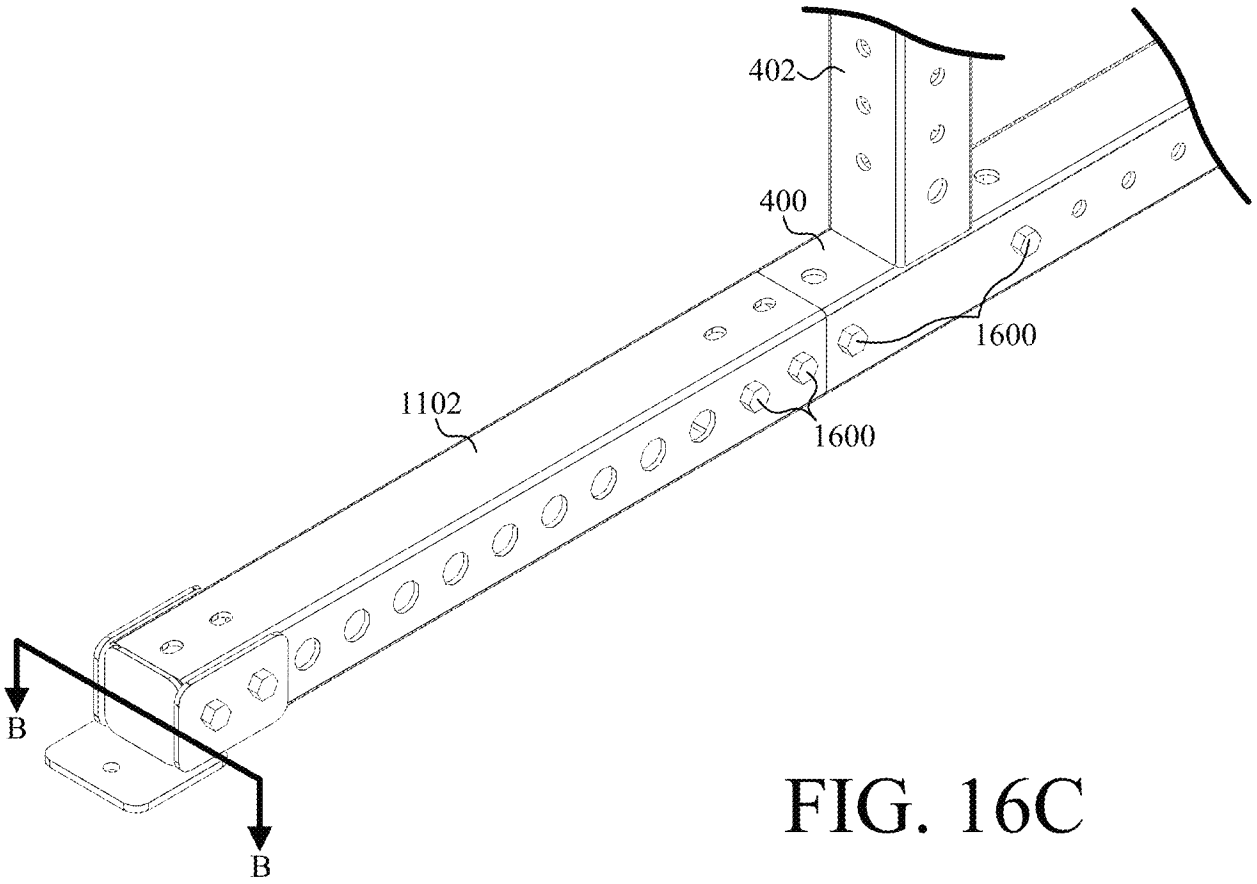
FIG. 16C illustrates a third step of coupling the frame leg of FIG. 12 to the frame of FIG. 1 with the coupler of FIG. 6.

FIGS. 16A-16C illustrate the coupling of one of legs 1102 to frame 100 with coupler 600.

As shown in FIG. 16A, leg 1102 and coupler 600 are aligned with the open end of base member 400 of frame 100. Also shown in FIG. 16A, a first set of two bolts 1600 are aligned with a respective two of slots 1304 of extender 1300, while a second set of two bolts 1600 are aligned with a respective two apertures 408 of base member 400.

As shown in FIG. 16B, coupler 600 is partially inserted into the open end of leg 1102, such that apertures 610 are aligned with apertures 1304. Bolts 1600 are disposed through apertures 1304 of leg 1102 and apertures 610 of coupler 600, and are threaded into a respective two of weld nuts 606. Bolts 1600 are not completely tightened at this point.

As shown in FIG. 16C, the remaining portion of coupler 600 protruding from leg 1102 is inserted into the open end of base member 400 such that apertures 608 of coupler 600 are aligned with apertures 408 of base member 400. The remaining two bolts 1600 are disposed through apertures 408 of base member 400 and apertures 608 of coupler 600, and are threaded into a respective two of weld nuts 606. Bolts 1600 are not completely tightened at this point. The remaining leg 1102 and both of legs 1100 are then coupled to frame 100 in the same fashion, while all of bolts 1600 remain slightly loose. Once all of legs 1100 and 1102 are coupled to frame 100 and frame 100 is settled in place, all of bolts 1600 are tightened. By waiting to tighten bolts 1600, unwanted rocking of frame 100 on the underlying surface is eliminated or at least minimized.

Figure 17:
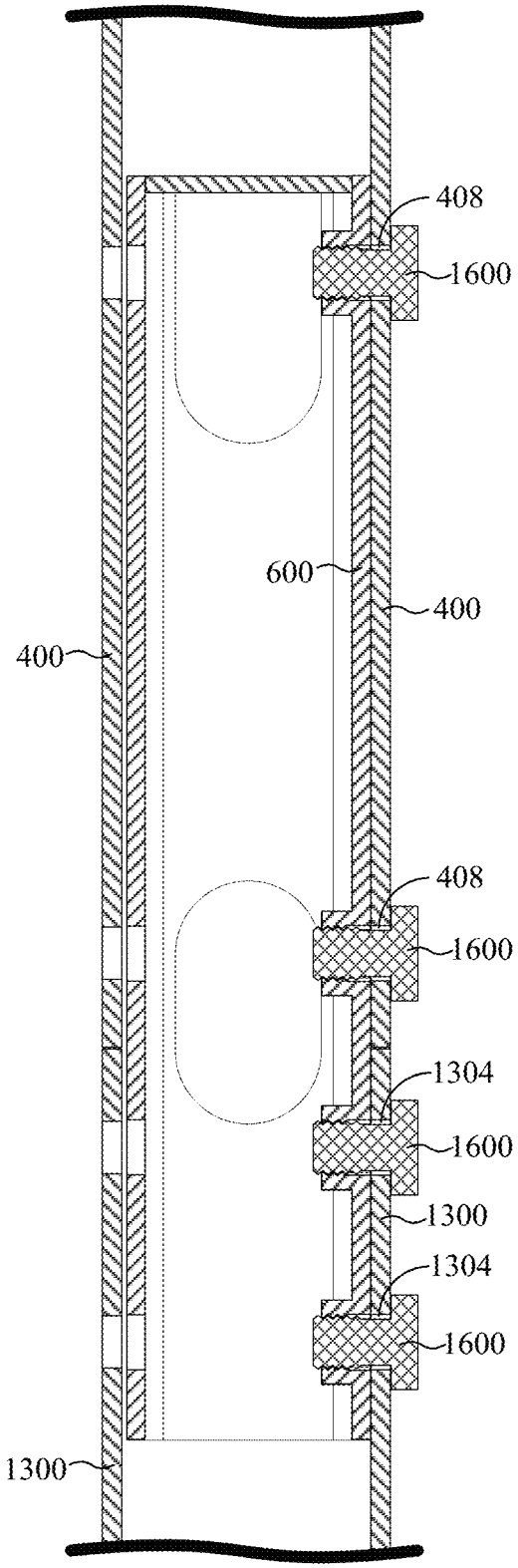
FIG. 17 is a cross-sectional view of the frame leg of FIG. 12 coupled to the frame of FIG. 1 via the coupler of FIG. 6, taken along line B-B of FIG. 16C.

FIG. 17 is a cross-sectional view taken along line B-B of FIG. 16C of extender 1102 coupled to base member 400 via coupler 600. Two of bolts 1600 are disposed through slots 1304 of extender 1300, disposed through apertures 610 of coupler 600, and threaded into a respective two of the four lock nuts 606 of coupler 600. Likewise, the remaining two bolts 1600 are disposed through apertures 408 of base member 400, through apertures 608 of coupler 600, and threaded into a respective two of the four lock nuts 606 of coupler 600. When bolts 1600 are tightened, coupler 600 is urged against the interior walls of extender 1300 and base member 400, thereby sandwiching the sidewalls of extender 1300 and base member 400 between the exterior surface of coupler 600 and the heads of bolts 1600. As a result of the aforementioned configuration, a solid joint is formed between extender 1300 and base member 400.

Optionally, coupler 600 may not include weld nuts 606. For example, long bolts passing completely through extender 1300 and coupler 600, and then fixed in place with a respective set of nuts, may be substituted for bolts 1600. Likewise, long bolts passing completely through base member 4000 and coupler 600, and then fixed in place with a respective set of nuts, may be substituted for the remaining bolts 1600.

Figure 18:
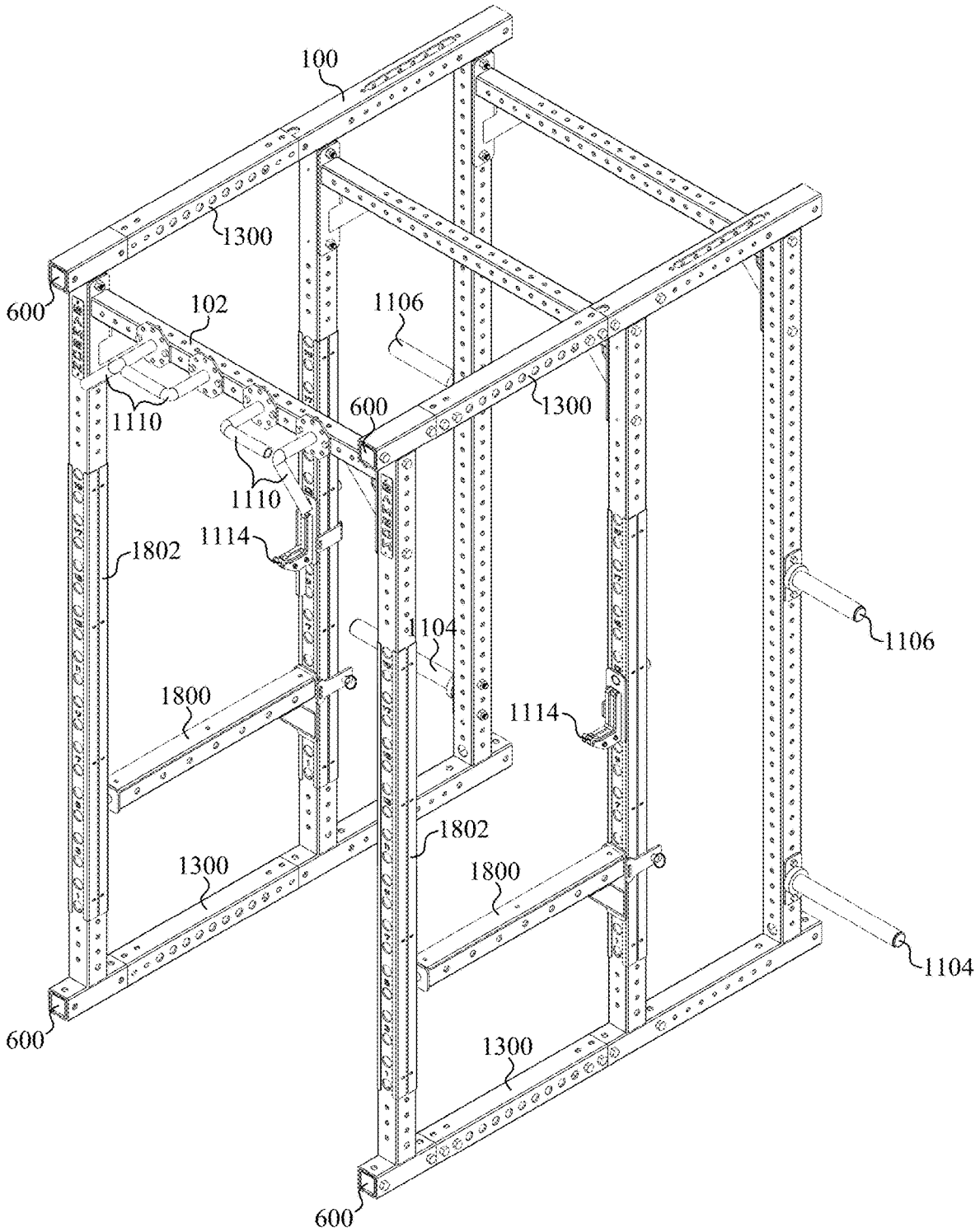
FIG. 18 is a perspective view of the frame of FIG. 1 having various modular components coupled thereto according to another example configuration.

FIG. 18 shows a perspective view of frame 100 having various modular components coupled thereto. In this second example configuration, the various modular components include two long weight horns 1104, two short weight horns 1106, two J-cup bar supports 1114, two reinforced spotter arms 1800, four frame extenders 1300, two column structures 1802, eight couplers 600, an additional cross support 102, and four pull-up handles 1110. Weight horns 1104 and 1106 are bolted to column 404 of frame 100 and are configured to support annular weights. Each J-cup bar support 1114 is adjustably coupled to a respective one of column 402. In this example, each J-cup bar support 1114 is disposed in one of hole numbers 13 of columns 402 but, as previously mentioned, may be selectively disposed in any one of the pairs of numbered apertures 412 according to user preference. Each of spotter arms 1800 are adjustably coupled between a respective one of columns 402 and a respective one of column structures 1802. Spotter arms 1800 are configured to, together, support heavy weight bars such as, for example, dead-lift bars. The form and function of spotter arms 1800 will be discussed below in greater detail with reference to FIG. 19. The bottom two of the four frame extenders 1300 are coupled to two respective open ends of base members 400 via two couplers 600 as previously described with reference to FIGS. 16A-C. The opposite ends of the two bottom frame extenders 1300 are coupled to respective bottom portions of column structures 1802 via two respective couplers 600. The top two of the four frame extenders 1300 are coupled to two respective open ends of top members 406 via two couplers 600 as previously described with reference to FIGS. 16A-C. The opposite ends of the two top frame extenders 1300 are coupled to the respective top portions of column structures 1802 via two respective couplers 600. The additional cross support 102 is bolted between both column structures 1802 and provides support to structures mounted thereon such as pull-up handles 1110.

Figure 19:
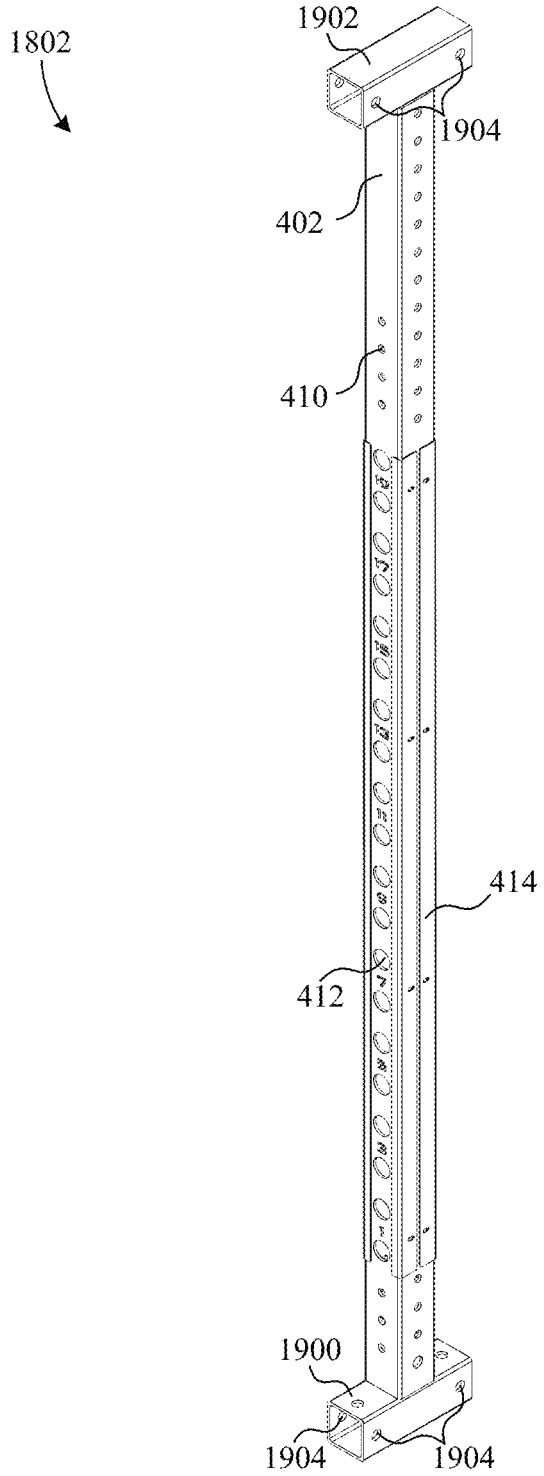
FIG. 19 is a perspective view of a column structure of FIG. 18.

FIG. 19 is a perspective view of column structure 1802, which includes a base member 1900, a column 402, and a top member 1902. The bottom end of column 402 is fixed (e.g. welded, mechanically fastened, etc.) to the top of base member 1900, while the top end of column 402 is fixed (e.g. welded, mechanically fastened, etc.) to the bottom of top member 1902. Each of base member 1900, column 402, and top member 1902 is formed from a respective section of steel square stock.

Base member 1900 provides support to column 402 and facilitates the attachment of various modular components (e.g., frame extenders, frame legs, cable weight components, etc.) to frame 100. The interior of base member 1900 is configured to receive a portion of a coupler 600. Accordingly, a first side of base member 1900 includes a set of two apertures 1904 having the same spacing therebetween as apertures 608 of coupler 600. The opposite second side of base member 1900 also includes a set of apertures 1904 (only one visible) that are coaxially aligned with apertures 1904 of the first side, respectively.

Column 402 of column structure 1802 is substantially similar to column 402 of support column 104 and, therefore, denoted with the same reference number. Although not shown, the rear side of column 402, opposite the visible front side defining numbered holes 412, is substantially a mirror image of the front side. That is, the rear side of column 402 also defines numbered holes 412 that are coaxially aligned with holes 412 of the front side.

Top member 1902 facilitates the attachment of column structure 1802 to frame 100. The interior of top member 1902 is configured to receive a portion of coupler 600. Accordingly, a first side of top member 1902 includes a set of two apertures 1904 having the same spacing therebetween as apertures 608 of coupler 600. The opposite second side of base member 1900 also includes a set of apertures 1904 (only one visible) that are coaxially aligned with apertures 1904 of the first side, respectively.

Figure 20A:
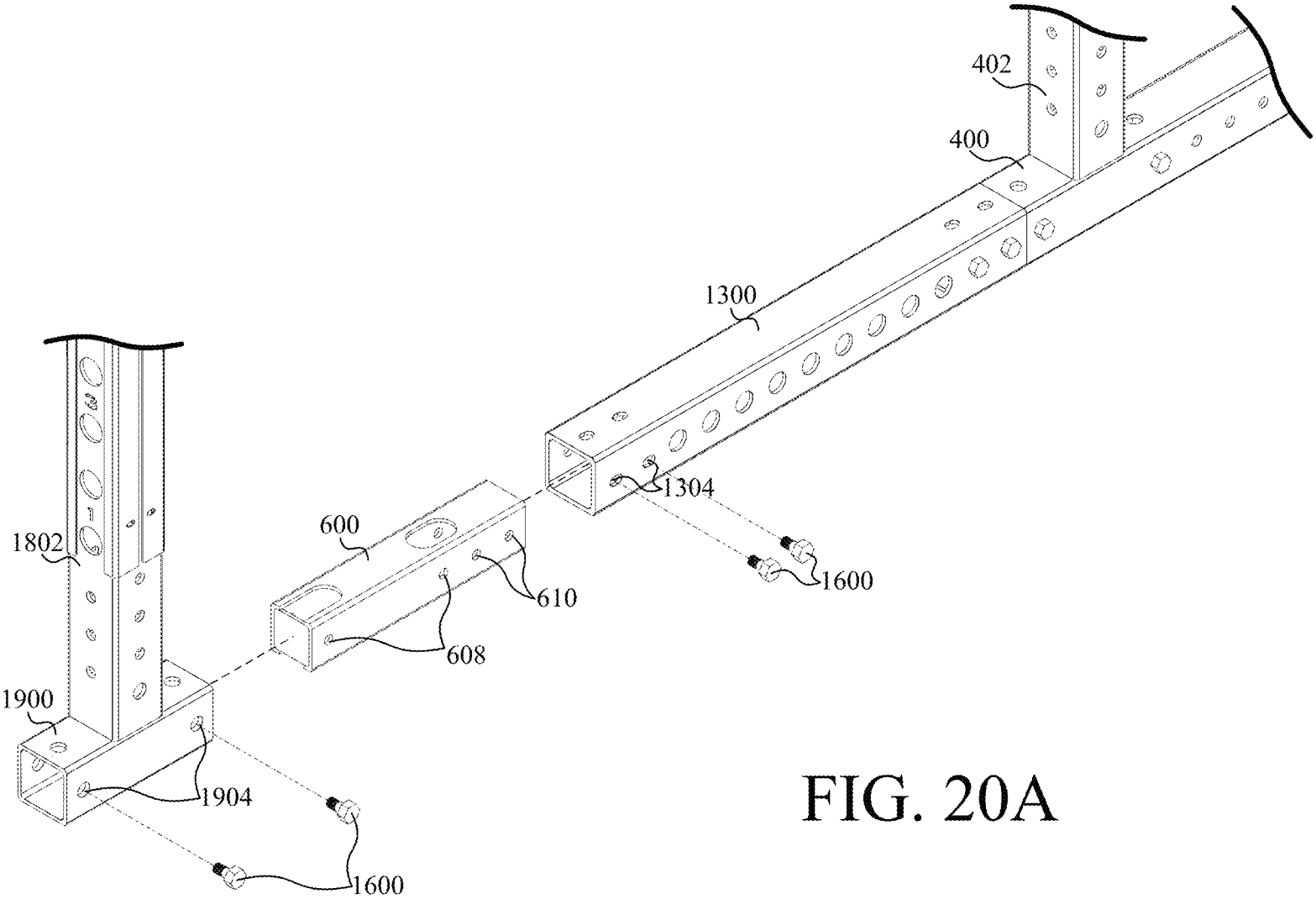
FIG. 20A illustrates a first step of coupling the column structure of FIG. 18 to a frame extender of FIG. 18 with the coupler of FIG. 6.
Figure 20B:
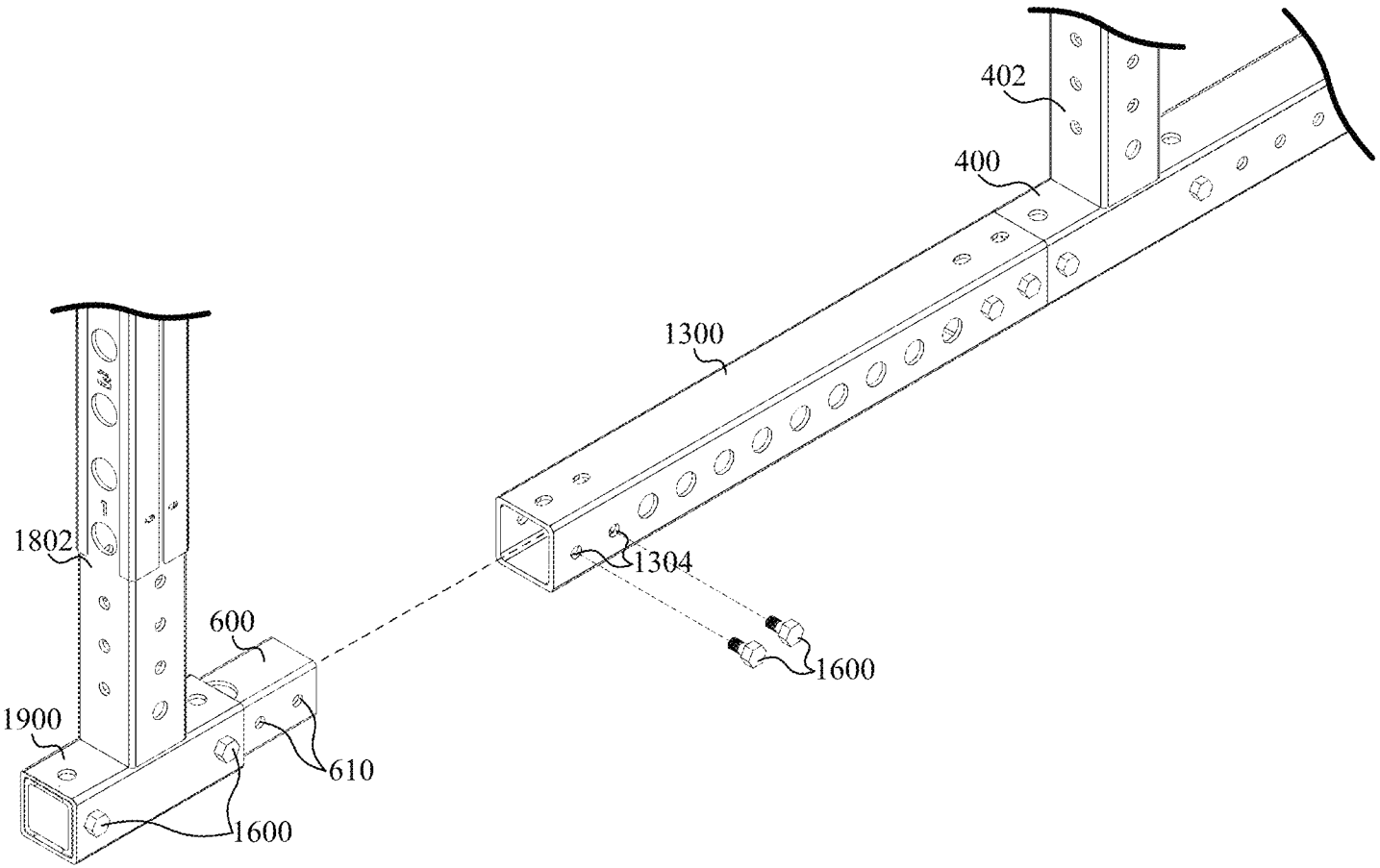
FIG. 20B illustrates a second step of coupling the column structure of FIG. 18 to the frame extender of FIG. 18 with the coupler of FIG. 6.
Figure 20C:
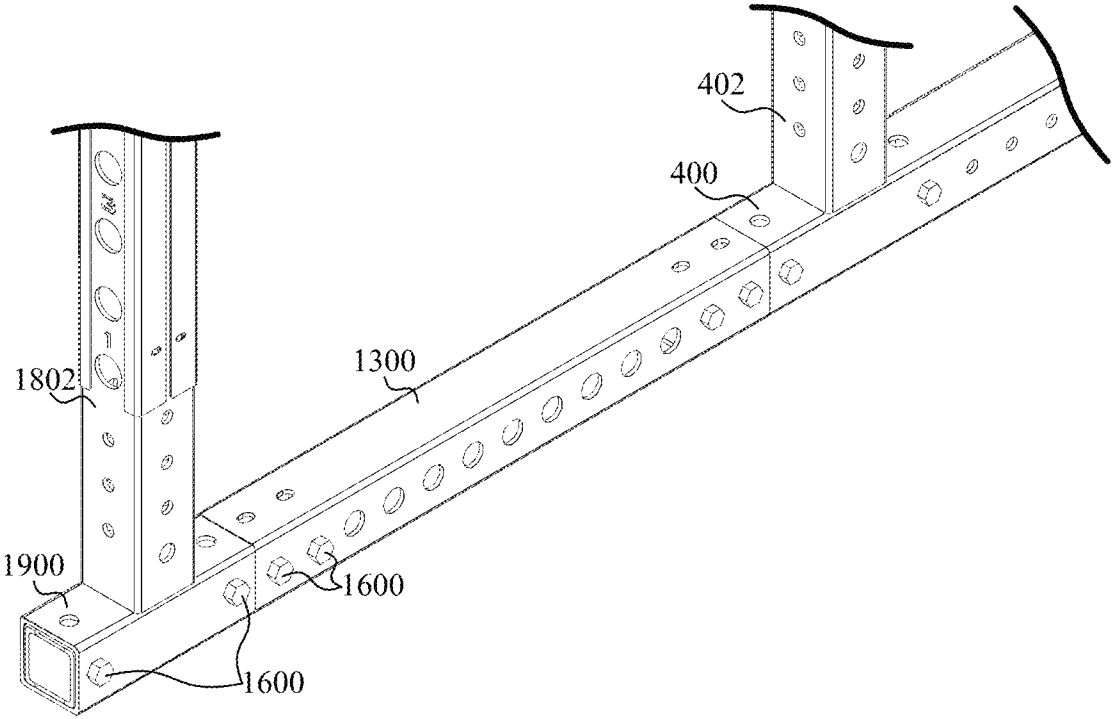
FIG. 20C illustrates a third step of coupling the column structure of FIG. 18 to the frame extender of FIG. 18 with the coupler of FIG. 6.

FIGS. 20A-20C illustrate the coupling of column structure 1802 to frame extender 1300 with a coupler 600. In this example use, coupler 600 provides two primary functions. One function of coupler 600 is to join column structure 1802 and frame extender 1300. Another function of coupler 600 is to close the otherwise open end of base member 1900.

As shown in FIG. 20A, coupler 600 is aligned between an open end of base member 1900 and an open end of frame extender 1300. Also shown in FIG. 16A, are two nuts 1600 aligned with a respective two apertures 1904 of base member 1900, and a second set of two nuts 1600 aligned with a respective two slots 1304 of frame extender 1300.

As shown in FIG. 20B, coupler 600 is partially inserted into the open end of base member 1900 such that apertures 608 are aligned with apertures 1904. Bolts 1600 are disposed through apertures 1904 of base member 1900 and apertures 608 of coupler 600, and are threaded into a respective two of weld nuts 606. Bolts 1600 are not completely tightened at this point.

As shown in FIG. 20C, the remaining portion of coupler 600 protruding from base member 1900 is inserted into the open end of frame extender 1300, such that apertures 610 of coupler 600 are aligned with slots 1304 of frame extender 1300. The remaining two bolts 1600 are disposed through slots 1304 of frame extender 1300 and apertures 610 of coupler 600, and are threaded into another respective two of weld nuts 606.

Figure 21:
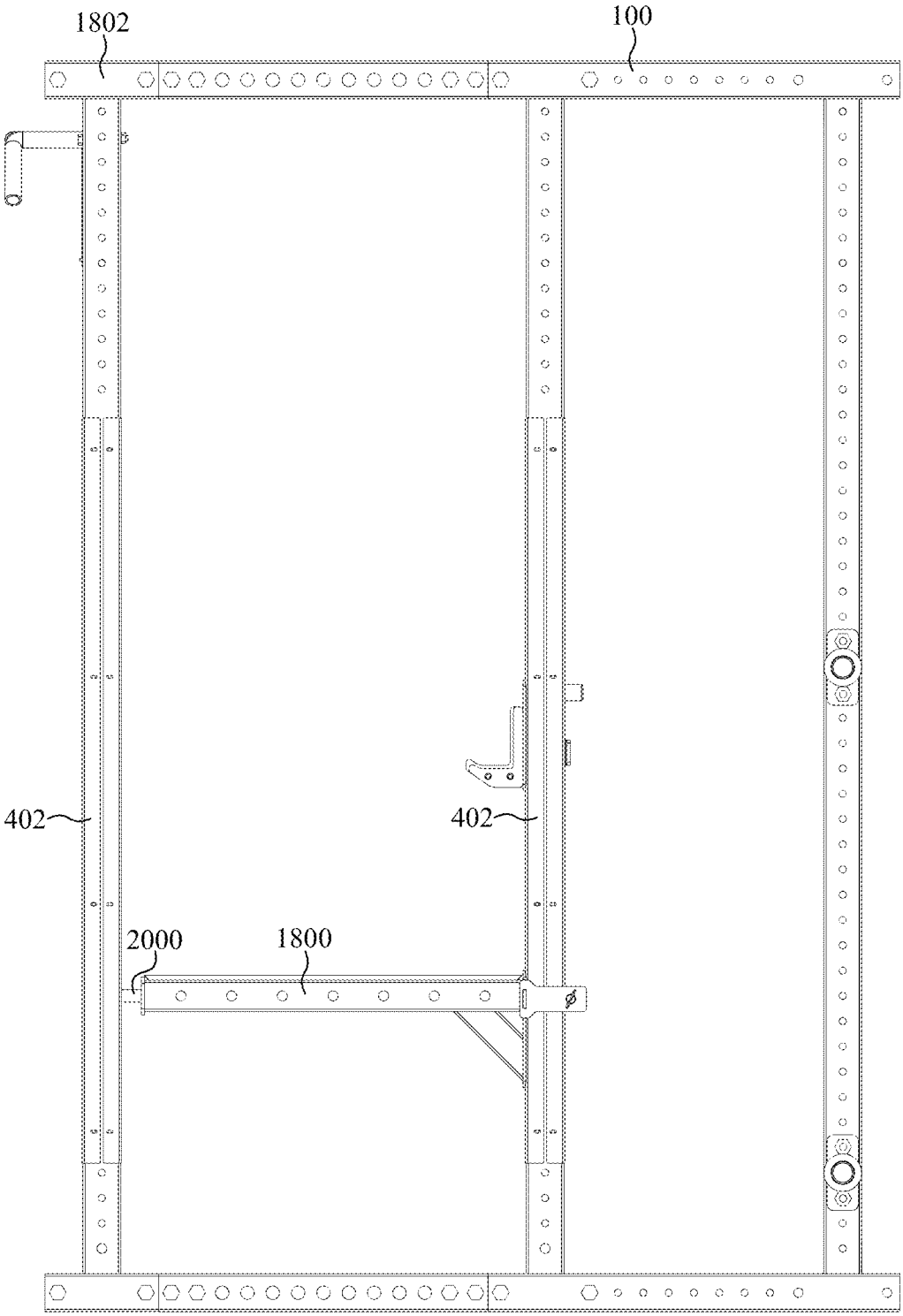
FIG. 21 is a side plan view of the frame of FIG. 1 having various modular components coupled thereto according to the example configuration of FIG. 18.

FIG. 21 is a side plan view of frame 100 and the various modular components coupled thereto according to the configuration illustrated in FIG. 18. As shown, spotter arm 1800 is supported on both ends by a first end that is selectively coupled to column 402 of frame 100 and an opposite second end that is selectively coupled to column 402 of column structure 1802. More specifically, a shaft 2000 protruding from the front of spotter arm 1800 is selectively inserted into one of holes 412 (not visible in the side plan view of FIG. 21) of column structure 1802, and another similar shaft (not visible) extending from the rear of spotter arm 1800 is inserted into one of holes 412 (not visible) of frame 100.

Holes 412 can be defined by any upright structure. As explained above with reference to FIG. 4, large holes 412 are configured to selectively receive a peg of spotter arms, J-cup bar supports, etc., and in the specific example of FIG. 21 to receive pins 2000.

Figure 22:
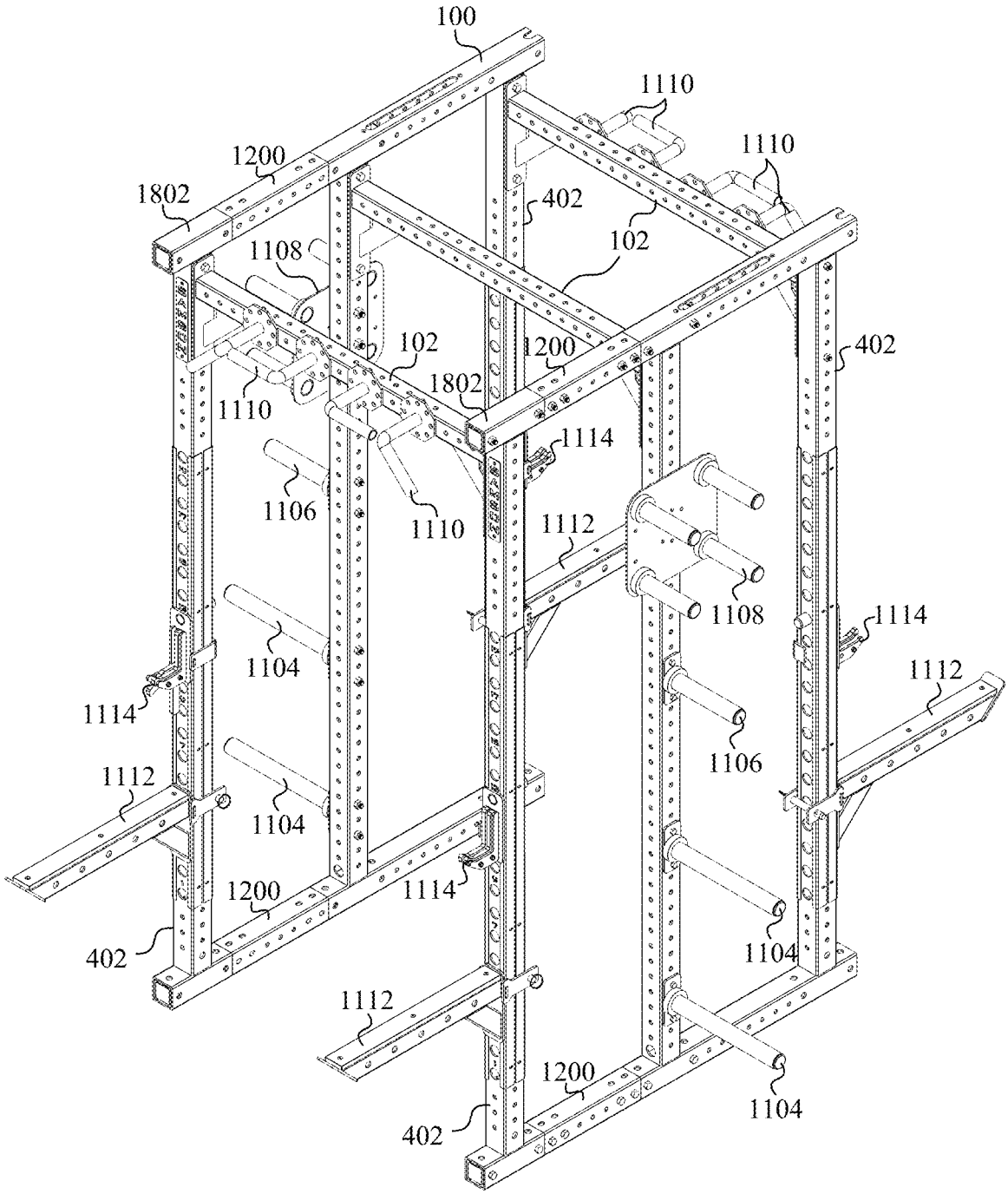
FIG. 22 is a perspective view of the frame of FIG. 1 having various modular components coupled thereto according to yet another example configuration.

FIG. 22 shows a perspective view of frame 100 having various modular components thereto. In this third example configuration, the various modular components include four long weight horns 1104, two short weight horns 1106, two weight horn assemblies 1108, four spotter arms 1112, four J-cup bar supports 1114, four frame extenders 1200, two column structures 1802, eight couplers 600, an additional cross support 102, and eight pull-up handles 1110.

There are two long weight horns 1104, one short weight horn 1106, and one weight horn assembly 1108 bolted to each of columns 404 of frame 100.

Two of spotter arms 1112 are coupled to columns 402 to, together, support a weight bar. Specifically, each of these two spotter arms 1112 is selectively coupled to a respective one of columns 402 of respective column structures 1802. Each of the other two spotter arms 1112 is selectively coupled to a respective one of columns 402 of frame 100 to, together, support another weight bar.

Each of the four J-cup bar supports 1114 is coupled to a respective one of columns 402. Specifically, two of J-cup bar supports 1114 are selectively coupled to respective columns 402 of column structures 1802 and two of J-cup bar supports 1114 are selectively coupled to respective columns 402 of frame 100.

Frame 100 is expanded into the configuration shown by mounting four frame extenders 1200 and two column structures 1802 thereto. Each frame extender 1200 includes a first end mounted to frame 100 via a respective coupler 600 (not visible) and a second end mounted to one of column structures 1802 via another respective coupler 600 (not visible). It should be recognized that four of the eight couplers 600 function purely as joints between frame extenders 1200 and frame 100. The other four couplers 600 function as joints between frame extenders 1200 and column structures 1802, and also function to close the otherwise open ends of column structures 1802. Cross support 102 is bolted between columns structures 1802. Four of the eight pull-up handles 1110 are bolted to the cross support 102 of frame 100 and the other four pull-up handles 1110 are mounted to the additional cross support 102 disposed between column structures 1802.

Figure 23:
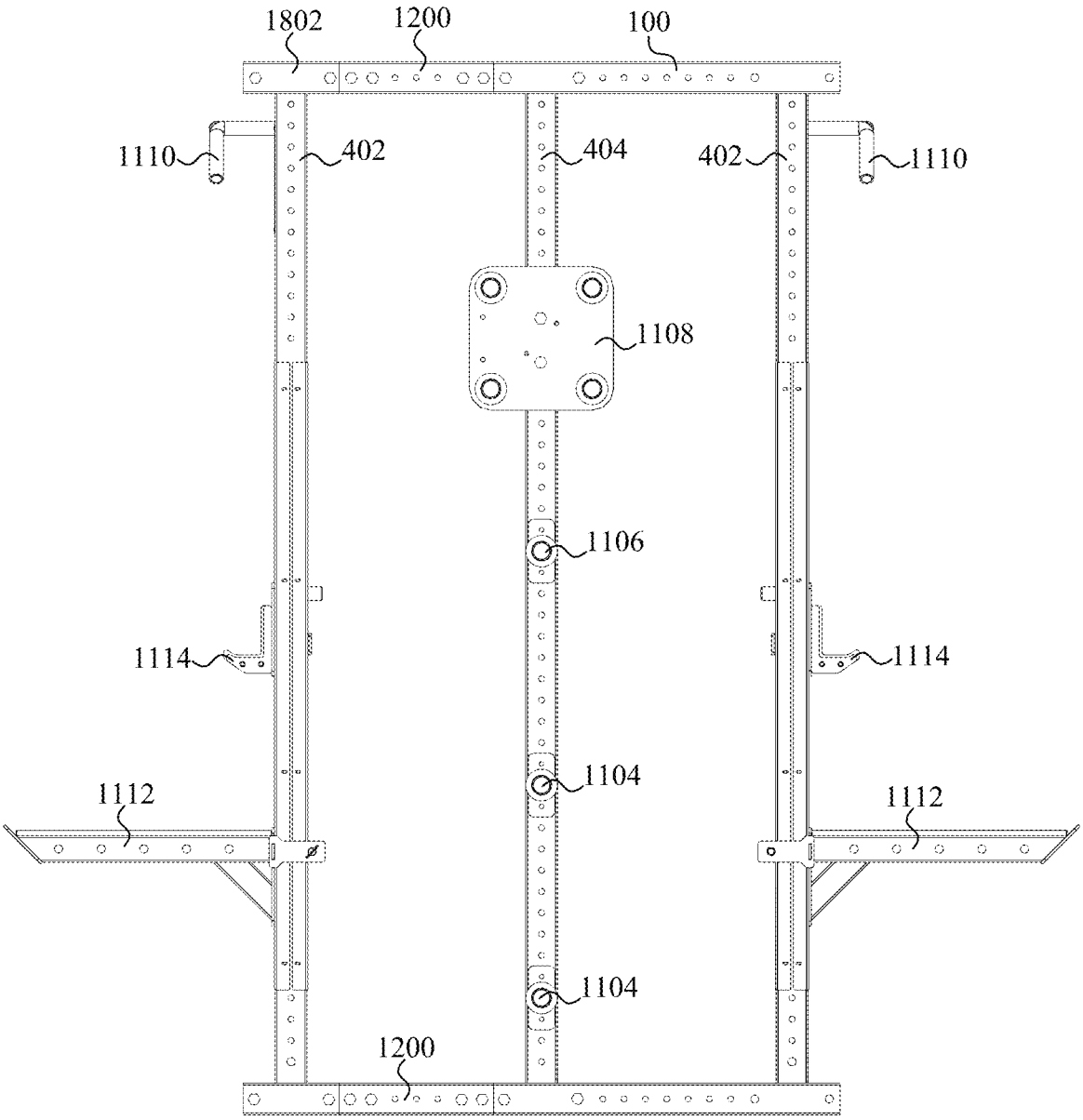
FIG. 23 is a side plan view of the frame of FIG. 1 having various modular components coupled thereto according to the example configuration of FIG. 22.

FIG. 23 shows a side plan view of frame 100 and the various modular components coupled thereto according to the configuration illustrated in FIG. 22. In this particular configuration, frame 100 and all the components coupled thereto, may host two users at once. That is, one user may workout at the front of the weight station while another user may workout at the rear of the weight station.

Figure 24:
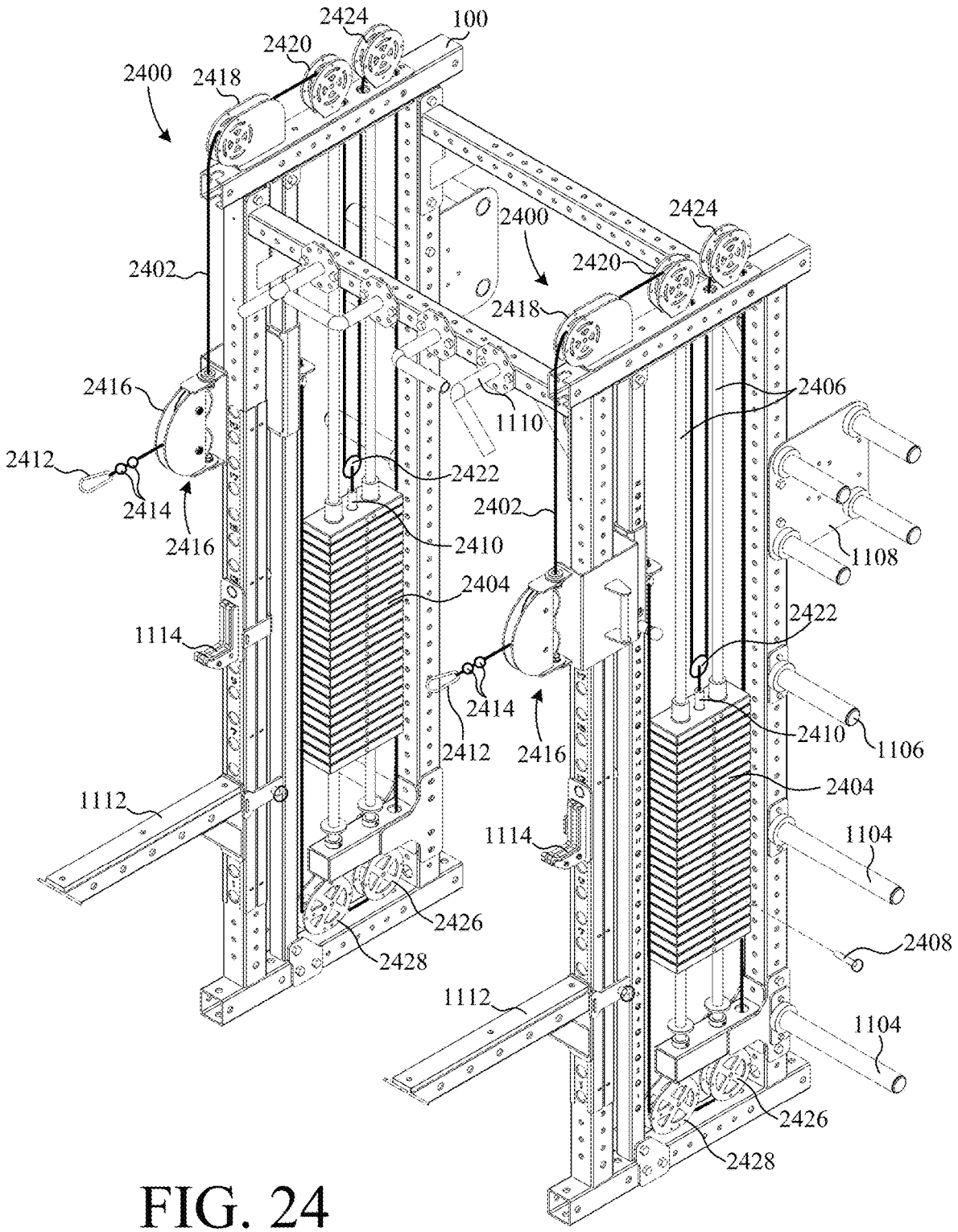
FIG. 24 is a perspective view of the frame of FIG. 1 having various modular components coupled thereto according to yet another example configuration.

FIG. 24 shows a perspective view of frame 100 having various modular components coupled thereto. In this fourth example configuration, the various modular components include four long weight horns 1104, two short weight horns 1106, two weight horn assemblies 1108, two J-cup bar supports 1114, two spotter arms 1112, four pull-up handles 1110, and two cable-weight assemblies 2400.

Two of weight horns 1104 are bolted to a first one of columns 404 of frame 100, and the other two of weight horns 1104 are bolted to the second one of columns 404 of frame 100. Each one of weight horns 1106 is bolted to a respective one of columns 404 of frame 100. Each one of J-cup bar supports 1114 is selectively coupled to a respective one of columns 402. Likewise, each of spotter arms 1112 is selectively coupled to a respective one of columns 402. Pull-up handles 1110 are bolted to cross support 102 of frame 100. Cable weight assemblies 2400 are bolted to frame 100 to, together, host single user workouts (i.e. cable cross-overs) and/or to host two separate user workouts that may be done at the same time and independent from one another.

Each of cable weight assemblies 2400 includes a cable 2402 that meanders through various pulleys and passages to lift a weight stack 2404 along a set of slider guide rods 2406. The user chooses how much of weight stack 2404 to lift by selectively inserting a pin 2408 through a chosen one of the weight plates of weight stack 2304, which in turn engages a lift rod 2410 disposed through an opening passing vertically through weight stack 2404. Cable 2402 includes a first end having a fastener 2412 and a set of stoppers 2414. Fastener 2412 facilitates the selective attachment of various cable accessories to cable 2402 such as, for example, single rigid handles, rope handles, double handle bars, etc. Stoppers 2414 prevent cable 2402 from retracting too far into a height adjustment assembly 2416 of cable weight assembly 2400.

The path which cable 2402 traverses will now be summarized, starting at fastener 2412. Cable 2402 initially passes through height adjustment assembly 2416 and is redirected upward along a vertical path. Cable 2402 then passes over a first pulley assembly 2418 that redirects it ninety degrees along a substantially horizontal path. Next, cable 2402 passes over a second pulley assembly 2420 where it is redirected downward ninety degrees along a substantially vertical path. Cable 2402 then passes through cable passage 418 (shown in FIG. 4) of frame 100. Then, cable 2402 is redirected 180° around a pulley 2422 that is mounted to rod 2310. Cable 2402 continues upward, passes back through cable passage 418, is again redirected 180° around a third pulley assembly 2424, and passes back downward through cable passage 418. The path continues downward and then is redirected 90° horizontally at fourth pulley assembly 2426. Then, cable 2402 is again redirected 90° in the upward direction at a fifth pulley assembly 2428. Cable 2402 continues upward until the second end of cable 2402, opposite the end attached to fastener 2412, is attached to an eye bolt (shown more clearly in FIG. 25 as eye bolt 2514) of height adjustment assembly 2416.

Figure 25:
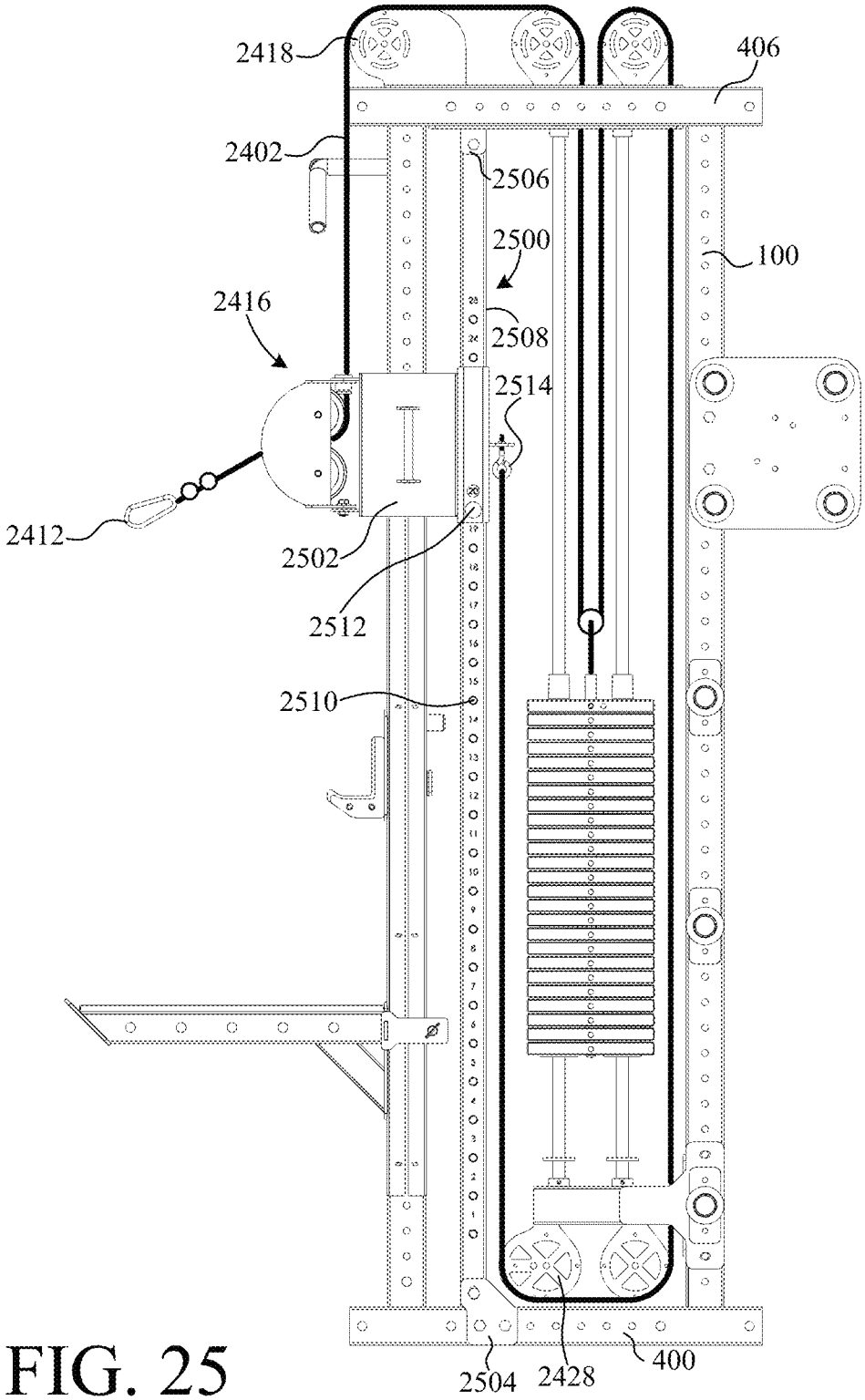
FIG. 25 is a side plan view of the frame of FIG. 1 having various modular components coupled thereto according to the example configuration of FIG. 24.

FIG. 25 shows a side plan view of frame 100 and the various modular components coupled thereto according to the configuration illustrated in FIG. 24.

Height adjustment assembly 2416 is configured to accommodate different user heights and different exercises by allowing a user to adjust the height of fastener 2412. Height adjustment assembly 2416 includes a column assembly 2500 and a pulley carrier 2502. Column assembly 2500 is removably mounted to frame 100 to support pulley carrier 2502. Column assembly 2500 includes a bottom bracket 2504, a top bracket 2506, and a column 2508. Bottom bracket 2504 is bolted between the bottom of column 2508 and base member 400 of frame 100, thereby removably coupling the bottom of column 2508 to base member 400 of frame 100. Top bracket 2504 is bolted between the top of column 2508 and top member 406 of frame 100, thereby removably coupling the top of column 2508 to top member 406 of frame 100. Column 2508 is formed from a section of stainless steel stock and includes a plurality of numbered holes 2510. Each of numbered holes 2510 is configured to selectively receive a locking mechanism 2512 of pulley carrier 2502. Accordingly, the height of pulley carrier 2502 may be adjusted by disengaging locking mechanism 2512 from one of numbered holes 2510, moving pulley carrier 2502 cither up or down along column 2508, and then releasing locking mechanism 2512, thereby allowing it to engage whichever one of numbered holes 2510 it is aligned with. As shown, the second end of cable 2402, opposite the end that is attached to fastener 2412, is attached to an eye-bolt 2514 that is fixed to pulley carrier 2502. Because both ends of cable 2402 are fixed with respect to pulley carrier 2502, the total of the length of cable between pulley 2418 and pulley carrier 2502 plus the length of cable between pulley 2428 and pulley carrier 2502 remains constant during height adjustment. Indeed, as the length of one section decreases, the length of the other section increases by the same amount.

Figure 26:
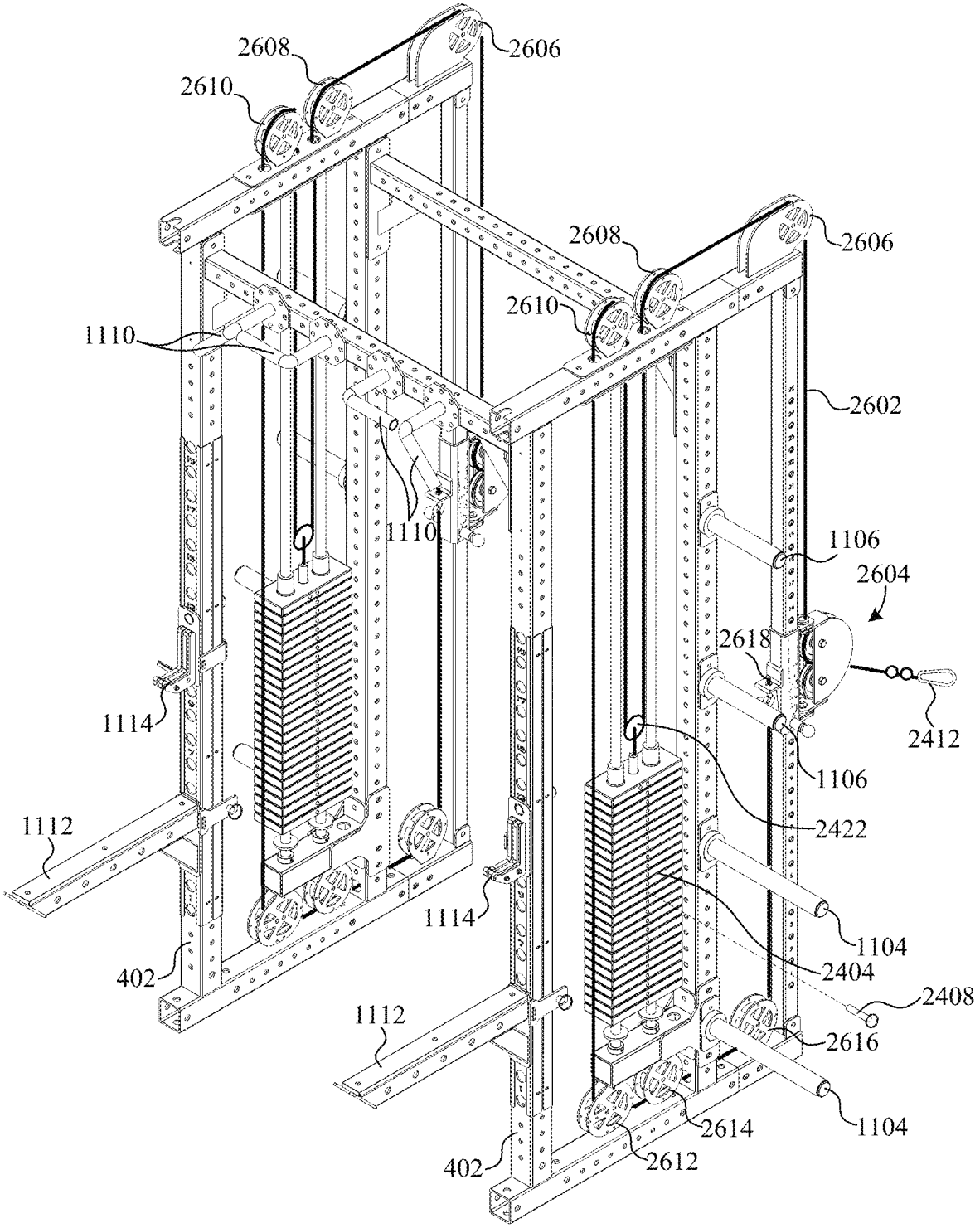
FIG. 26 is a perspective view of the frame of FIG. 1 having various modular components coupled thereto according to yet another example configuration.

FIG. 26 shows a perspective view of frame 100 having various modular components coupled thereto. In this fifth example configuration, the various modular components include four long weight horns 1104, four short weight horns 1106, two J-cup bar supports 1114, two spotter arms 1112, four pull-up handles 1110, and two cable-weight assemblies 2600.

Two of weight horns 1104 are bolted to a first one of columns 404 of frame 100 and the other two of weight horns 1104 are bolted to the second one of columns 404 of frame 100. Likewise, two of weight horns 1106 are bolted to a first one of columns 404 of frame 100 and the other two of weight horns 1106 are bolted to the second one of columns 404 of frame 100. Each one of J-cup bar supports 1114 is selectively coupled to a respective one of columns 402. Likewise, each of spotter arms 1112 is selectively coupled to a respective one of columns 402. Pull-up handles 1110 are bolted to cross support 102 of frame 100. Cable weight assemblies 2400 are bolted to frame 100 to, together, host single user workouts (i.e. cable cross-overs) and/or to host two separate user workouts that may be done at the same time and independent of one another. Each of the two cable-weight assemblies 2600 is mounted to frame 100 via two couplers 600 (not visible).

Each of cable weight assemblies 2600 includes a cable 2602 that meanders through various pulleys and passages to lift weight stack 2404 along slider guide rods 2406. The user chooses how much of weight stack 2404 to lift by selectively inserting pin 2408 through a chosen one of the weight plates of weight stack 2404, which in turn engages lift rod 2410 disposed through an opening passing vertically through weight stack 2404. Cable 2602 includes a first end having a fastener 2412 and a set of stoppers 2414.

The path along which cable 2602 travels will now be summarized starting at fastener 2412. Cable 2602 initially passes through a height adjustment assembly 2604 of cable weight assembly 2600 and is redirected upward along a vertical path. Cable 2602 then passes over a first pulley assembly 2606 that redirects it ninety degrees along a substantially horizontal path. Next, cable 2602 passes over a second pulley assembly 2608, where it is redirected downward ninety degrees along a substantially vertical path. Cable 2602 then passes through cable passage 418 (shown in greater detail in FIG. 4) of frame 100. Then, cable 2602 is redirected 180° around pulley 2422, which is mounted to rod 2310. Cable 2602 continues upward, passes back through cable passage 418, is again redirected 180° around a third pulley assembly 2610, and passes back downward through cable passage 418. The path continues downward and then is redirected 90° horizontally by fourth pulley assembly 2612. Cable 2602 then passes over a fifth pulley assembly 2614 but is not redirected. Then, cable 2602 is again redirected 90° in the upward direction by a sixth pulley assembly 2616. Cable 2602 continues upward until the second end of cable 2602, opposite the end attached to fastener 2412, is attached to an eye bolt 2618 of height adjustment assembly 2604.

Figure 27:
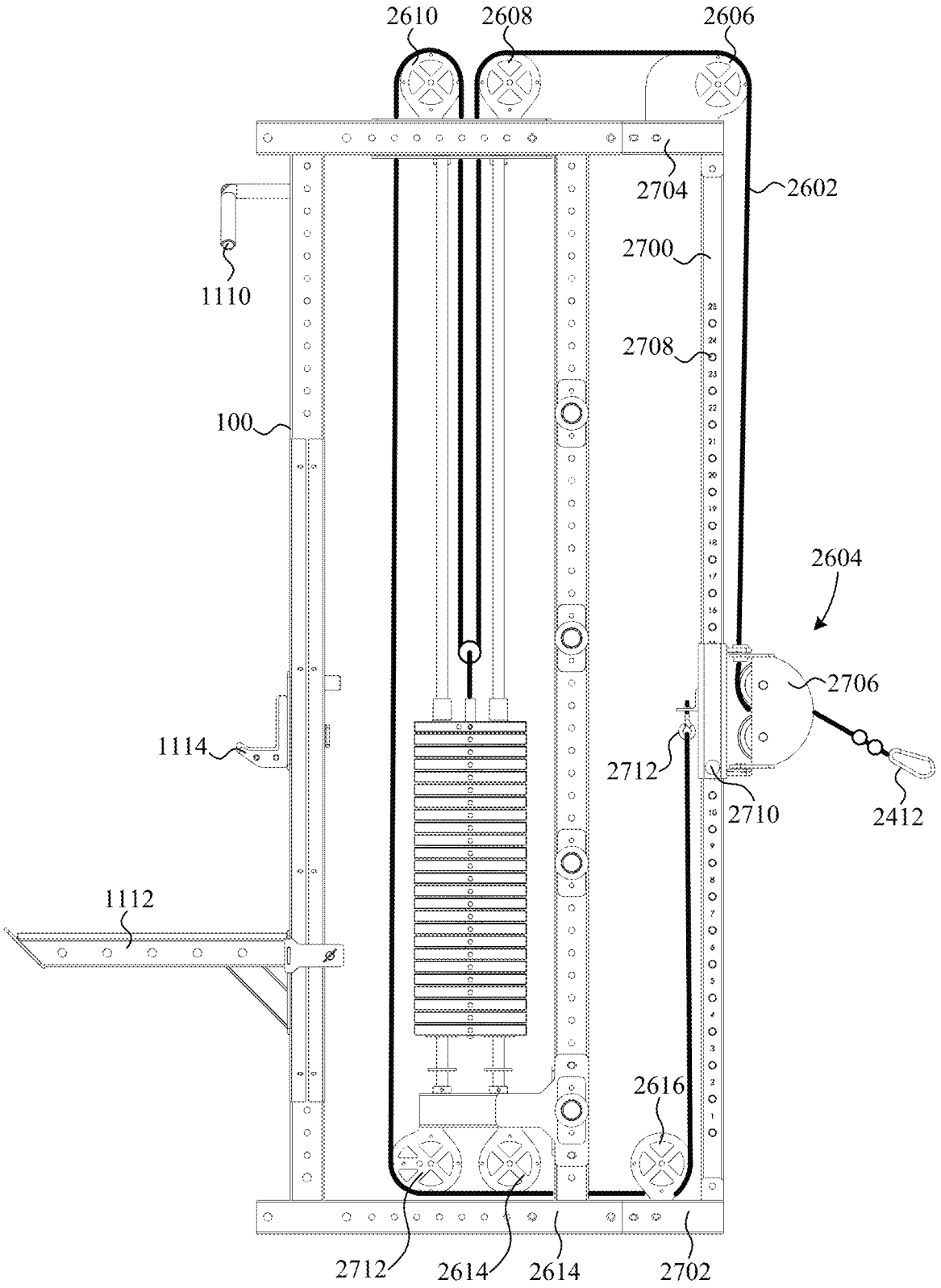
FIG. 27 shows a side plan view of the frame of FIG. 1 having various modular components coupled thereto according to the example configuration of FIG. 26.

FIG. 27 shows a side plan view of frame 100 and the various modular components coupled thereto according to the configuration illustrated in FIG. 26.

Height adjustment assembly 2604 is configured to accommodate different user heights and different exercises by allowing a user to adjust the height of fastener 2412. Height adjustment assembly 2604 includes a column 2700, a lower extension 2702, an upper extension 2704, and a pulley carrier 2706. Column 2700 is, by way of non-limiting example, a stainless steel structure having a plurality of numbered holes 2708 formed therethrough. Each of numbered holes 2708 corresponds to different height at which pulley carrier 2706 may be selectively positioned. Lower extension 2702 is attached to base member 400 via a coupler 600 (not visible) as previously described. Lower extension 2702 is also bolted to the bottom portion of column 2700. Upper extension 2704 is attached to top member 406 via a coupler 600 (not visible). Upper extension 2704 is also bolted to the top portion of column 2700. Both lower extension 2702 and upper extension 2704 are formed from sections of steel square stock having the same cross-sectional profile as that of the sections of square stock from which frame 100 is made.

Pulley carrier 2706 is adjustably coupled to column 2700. Each of numbered holes 2708 is configured to selectively receive a locking mechanism 2710 of pulley carrier 2706. Accordingly, the height of pulley carrier 2706 may be adjusted by disengaging locking mechanism 2710 from one of numbered holes 2708, moving pulley carrier 2706 either up or down along column 2700, and then releasing locking mechanism 2710, thereby allowing it to engage whichever one of numbered holes 2700 it is aligned with. As shown, the second end of cable 2602, opposite the end that is attached to fastener 2412, is attached to an eye-bolt 2712 that is fixed to pulley carrier 2706. Because both ends of cable 2602 are fixed with respect to pulley carrier 2706, the total of the length of cable between pulley 2606 and pulley carrier 2706 plus the length of cable between pulley 2702 and pulley carrier 2706 remains constant during height adjustment. Indeed, as the length of one section decreases, the length of the other section increases by the same amount.

Figure 28:
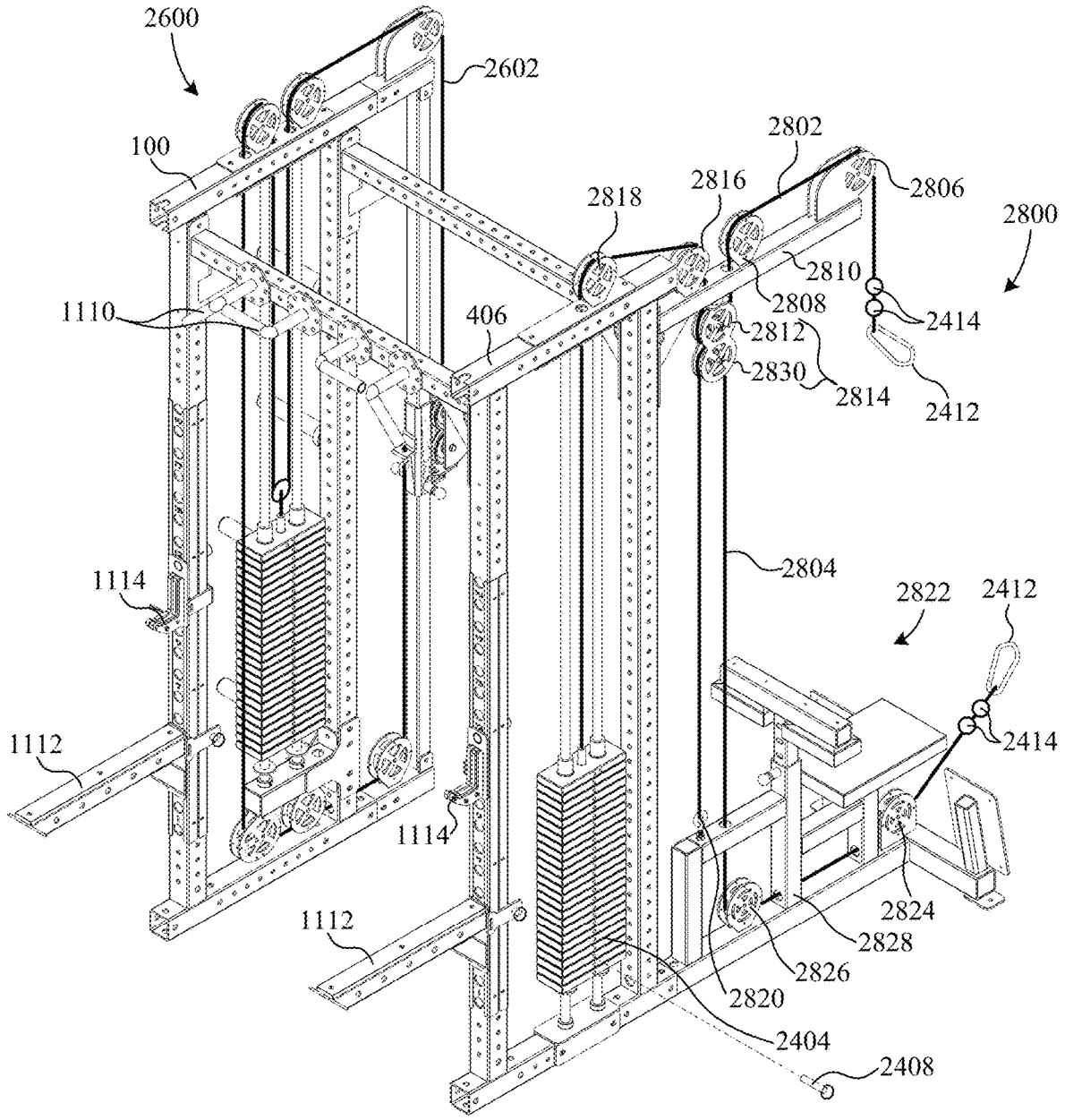
FIG. 28 is a perspective view of the frame of FIG. 1 having various modular components coupled thereto according to yet another example configuration.

FIG. 28 shows a perspective view of frame 100 having various modular components coupled thereto. In this sixth example configuration, the various modular components include two long weight horns 1104, two short weight horns 1106, two J-cup bar supports 1114, two spotter arms 1112, four pull-up handles 1110, a first cable weight assembly 2600, and a second cable-weight assembly 2800. Weight horns 1104 and 1106 are removably bolted to the same one of columns 404. Each of spotter arms 1112 is selectively coupled to a respective one of columns 402. Likewise, each one of J-cup bar supports 1114 is selectively coupled to a respective one of columns 402. Pull-up handles 1110 are bolted to cross support 102 of frame 100. Cable weight assembly 2600 is attached to one side of frame 100 and cable weight assembly 2800 is attached to the other side of frame 100. In this particular configuration, each of weight assemblies 2600 and 2800 may be used at the same time and by different users. Each of cable-weight assemblies 2600 and 2800 are mounted to frame 100 via a respective two couplers 600 (not visible).

Cable-weight assembly 2800 hosts various optional cable weight exercises including, but not limited to, cable pull-downs, rows, etc. Cable-weight assembly 2800 includes a first cable 2802 and a second cable 2804, both of which are coupled to lift some or all of a weight stack 2404. Cables 2802 and 2804 meander through various pulleys and passages to lift weight stack 2404 along slider rods 2406.

Cable 2802 includes a first end attached to a fastener 2412 and a set of stoppers 2414. Fastener 2412 facilitates the removable attachment of various types of handle mechanisms (e.g., pull-down bar, rope handles, single handles, etc.) to cable 2802. Stoppers 2414 prevent cable 2802 from being pulled too far into the cable path when cable 2804 is being used. The second end of cable 2802 is fixed to lift rod 2410, which selectively attaches to a chosen one of the weight plates of weight stack 2404 via pin 2408.

The path which cable 2802 traverses will now be described. Starting at fastener 2412, cable 2802 extends vertically upward to a first pulley 2806, where cable 2802 is redirected 90° along a horizontal path. Cable 2802 is then redirected 90° around a second pulley 2808 to extend vertically downward through a boom arm 2810. Next, cable 2802 is redirected 180° around a third pulley 2812, which is part of a floating pulley assembly 2814. Cable 2802 then extends vertically upward through boom arm 2810 where it is redirected less than 90° around a fourth pulley 2816.

Cable 2802 continues at an upward angle to a fifth pulley 2818 where it is redirected to extend straight downward through top member 406, to lift rod 2410. As shown, pulleys 2806, 2808, and 2816 are mounted to boom arm 2810, which is removably bolted to one of columns 104.

Cable 2804 includes a first end attached to a fastener 2412 and a set of stoppers 2414. The opposite second end of cable 2804 is anchored to an eye-bolt 2820 of a seat assembly 2822 of cable-weight assembly 2800.

The path which cable 2804 traverses is described as follows. Starting at fastener 2412, cable 2804 is routed over a first pulley 2824, where it is directed to extend horizontally to a second pulley 2826, through the frame 2828 of seat assembly 2822. Pulley 2826 redirects cable 2804 90° along a vertical path where it again passes through frame 2828 of seat assembly 2822. Cable 2804 continues upward and is redirected 180° around a third pulley 2830, which is part of floating pulley assembly 2814. Cable 2804 continues downward and is attached to eye-bolt 2820.

Figure 29A:
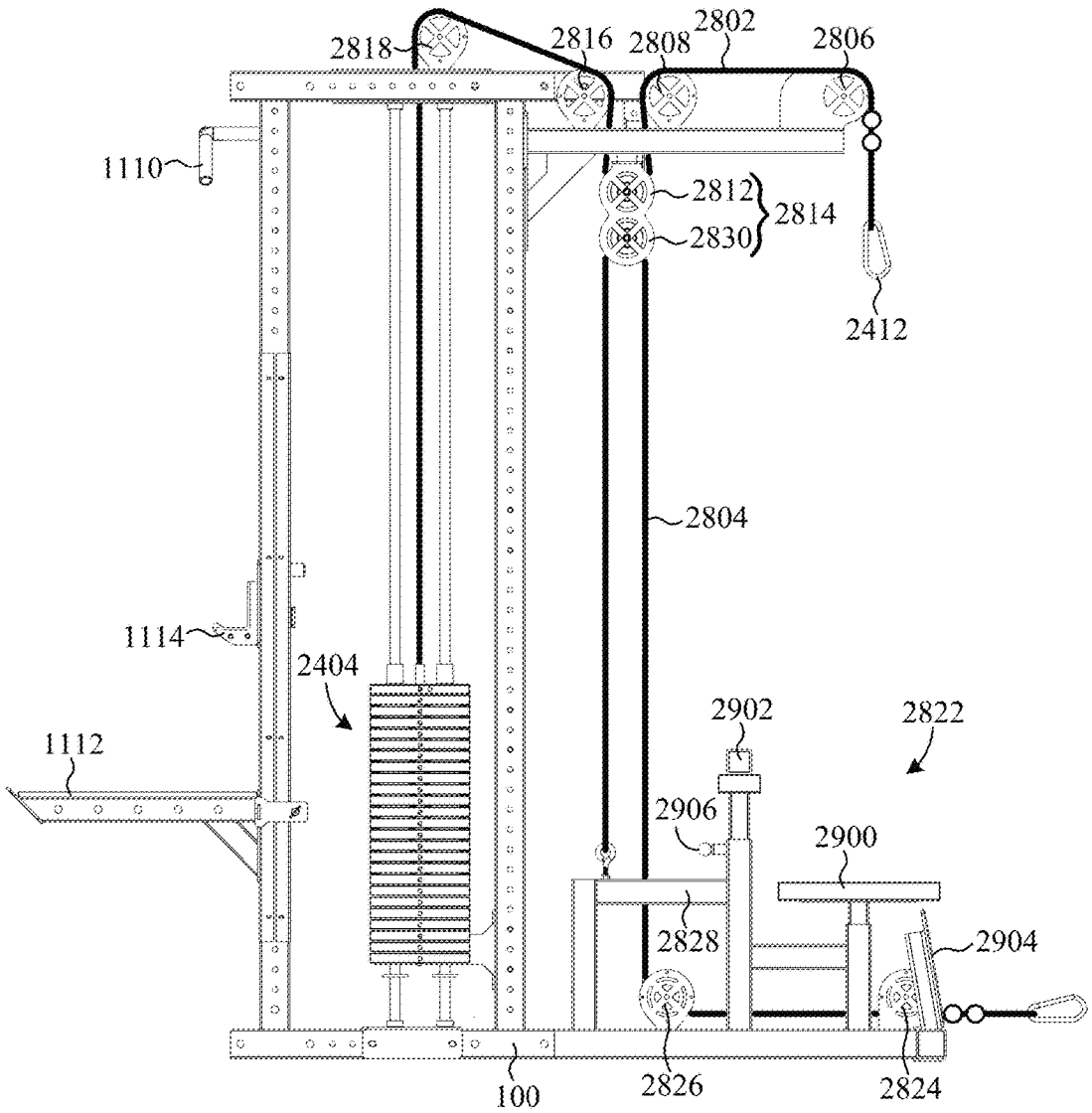
FIG. 29A is a side plan view of the frame of FIG. 1 having various modular components coupled thereto according to the example configuration of FIG. 28.
Figure 29B:
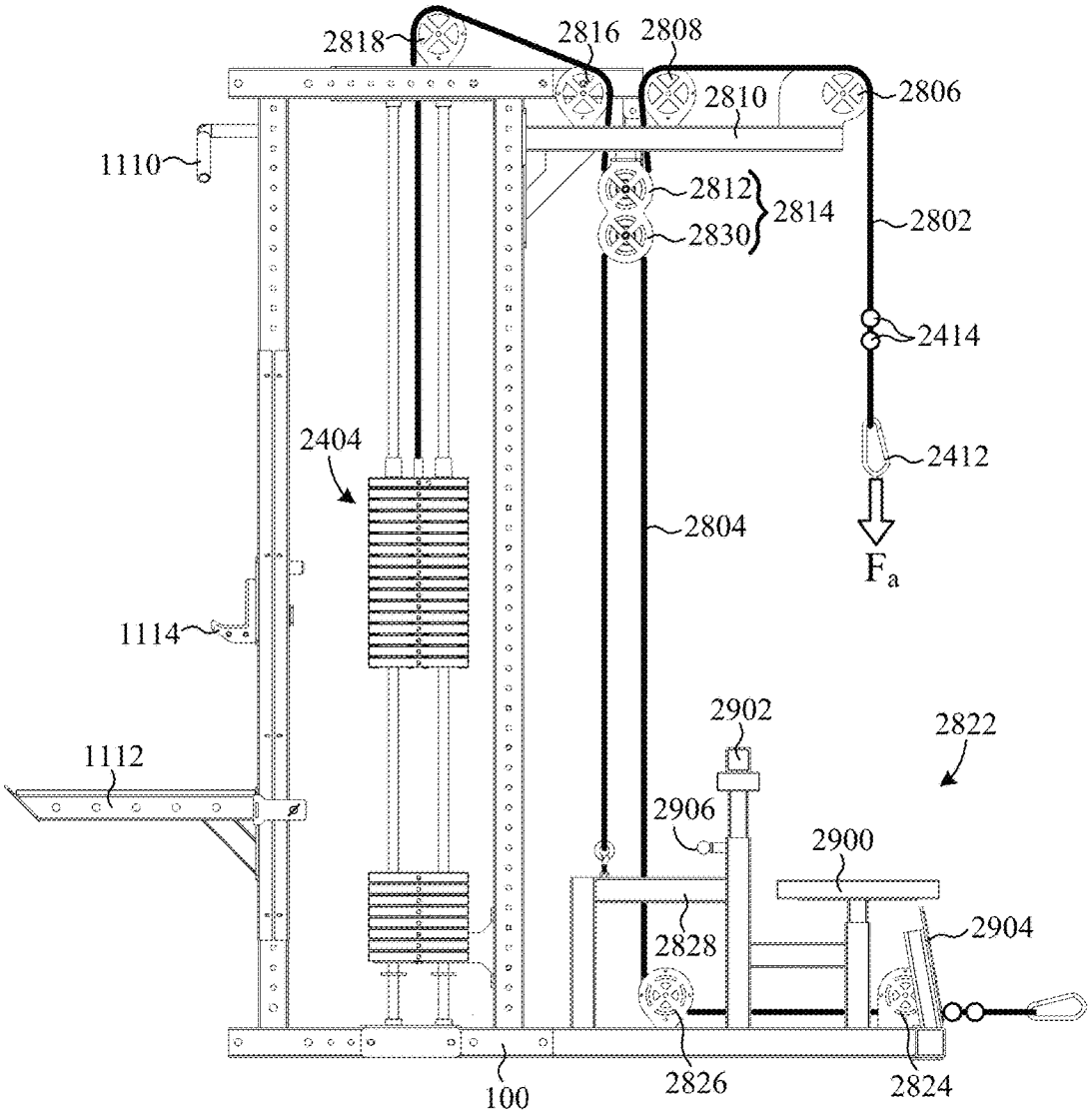
FIG. 29B shows a side plan view of the frame of FIG. 1 having various modular components coupled thereto according to the example configuration of FIG. 28, wherein a force is being applied to one of the cables.
Figure 29C:
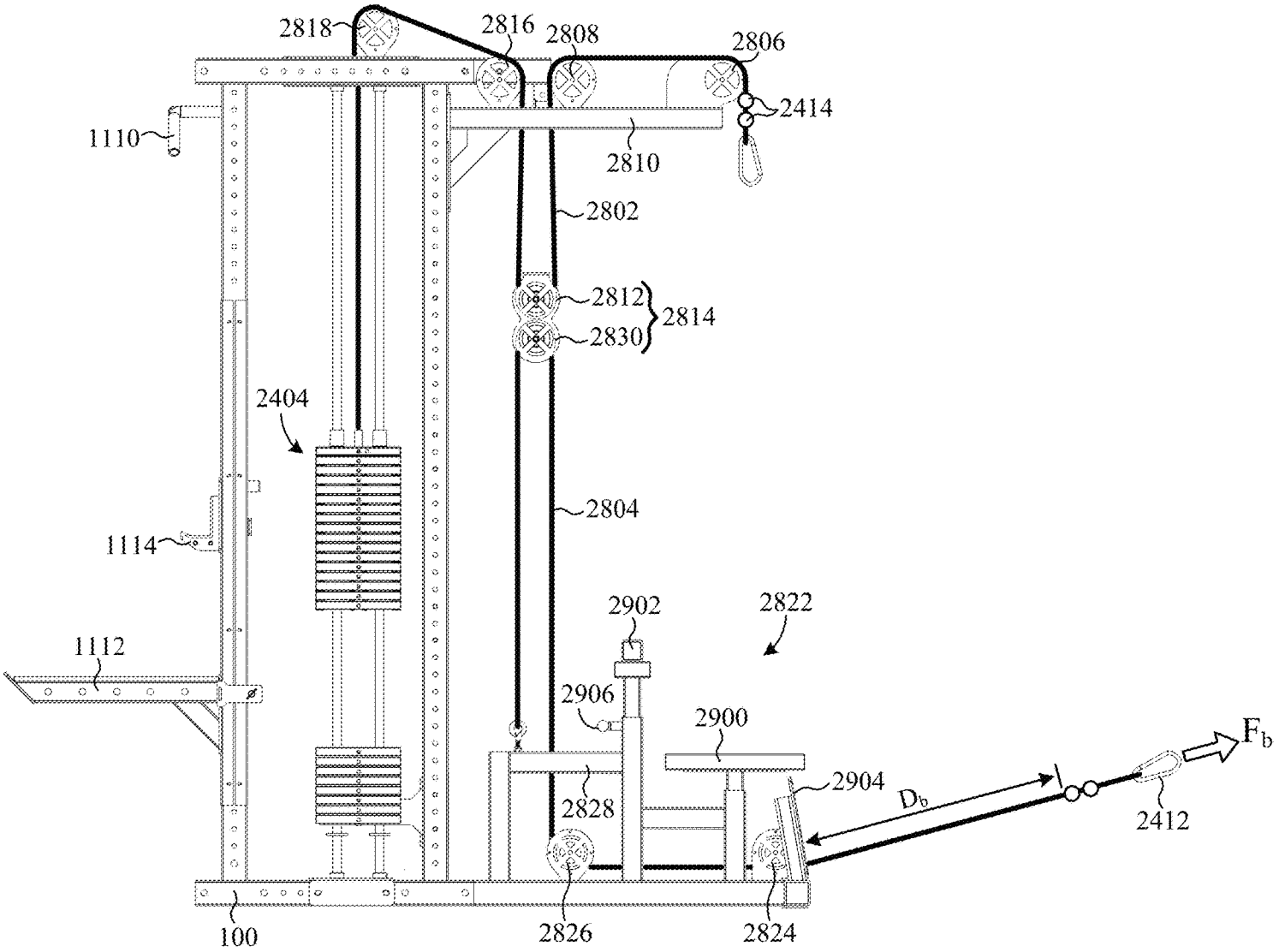
FIG. 29C shows a side plan view of the frame of FIG. 1 having various modular components coupled thereto according to the example configuration of FIG. 28 wherein a force is being applied to another one of the cables.

FIGS. 29A-C show side plan views of frame 100 and the various modular components coupled thereto according to the configuration illustrated in FIG. 28. Specifically, FIG. 29A shows the configuration of FIG. 28 with both cables 2802 and 2804 positioned as when they are not in use. FIG. 29B shows the configuration of FIG. 28 with cable 2802 being pulled by a force Fa and cable 2802 not in use. FIG. 29C shows the configuration of FIG. 28 with cable 2802 not in use and cable 2804 being pulled by a force $F_b$. Note that cable-weight assembly 2600 has been removed from FIGS. 29A-29C to more clearly illustrate cable-weight assembly 2800.

As shown in FIG. 29C, seat assembly 2822 includes frame 2828 that supports a seat 2900, a thigh engagement structure 2902, and a set of platforms 2904. Frame 2828 is attached to frame 100 by a coupler 600 (not shown). Seat 2900 is mounted to frame 2828 and provides a cushioned sitting surface for users. Thigh engagement structure 2902 is padded structure that is configured to engage both thighs of a user sitting on seat 2900 to prevent the user from lifting off of seat 2900 when pulling on a handle attached to fastener 2412 of cable 2802. Structure 2902 is adjustably coupled to frame 2828 to accommodate different sized users. The height of structure 2902 may be adjusted by pulling on a locking mechanism 2906, thereby freeing structure 2902 to be moved vertically with respect to frame 2828. Once structure 2902 is at a desired height, the user releases locking mechanism 2906 thereby locking the position of structure 2902 with respect to frame 2828.

As illustrated in FIG. 29B, floating pulley assembly 2814 urges against the bottom of boom arm 2810 as cable 2802 rolls across pulleys 2806, 2808, 2812, 2816, and 2818 responsive to applying a force Fa to fastener 2412 of cable 2802. The linear displacement of fastener 2412 of cable 2802 is equal to the distance that some or all of weight stack 2404 is lifted.

As illustrated in FIG. 29C, stoppers 2414 of cable 2802 engage pulley 2806 and floating pulley assembly 2814 moves downward, away from boom arm 2810 when a force $F_b$ is applied to fastener 2412 of cable 2804. Accordingly, the displacement $D_b$ of cable 2804 is twice the distance that floating pulley assembly 2814 moves away from boom arm 2810 and also twice the distance that some or all of weight stack 2404 moves upward when force $F_b$ is applied to fastener 2412 of cable 2804. Responsive to applying force $F_a$ to fastener 2412 of cable 2804, cable 2804 rolls across pulleys 2824, 2826, and 2830, while cable 2802 rolls across pulleys 2812, 2816, and 2818.

An important advantage of the present invention is that all of the example configurations described herein, and many others not described, can be assembled around frame 100. Indeed, any of the various model components and configurations can be assembled around frame 100 in any desirable combination. As a result, a user can start with a basic configuration built around frame 100 and than expand the frame to include additional components in the future.

One aspect of frame 100 that facilitates the described modular expansion is that frame 100 includes a set of receivers configured to accept universal couplers 600. In the example embodiments, the open ends of base members 400 and top members 406 function as the individual receivers. Alternatively, the receivers can be separate from base members 400 and top members 406 and coupled to frame 100 at different locations. However, using the open ends of base members 400 and top members 406 as the receivers provides an effective and efficient solution. For example, the open ends of base members 400 and top members 406 provide a first rectangular array of receivers on a first side of frame 100 facing in a first direction, and a second rectangular array of receivers on a second side of frame 100 and facing in second direction opposite the first direction. As a result, the first array of receivers can be used to build any desirable configuration of equipment off of the first side of frame 100, and the second set of receivers can be used to build any other desirable configuration of equipment off of the second side of frame 100, all using the same universal couplers 600 and without permanently modifying frame 100. Moreover, the equipment built onto the first side of frame 100 can be completely different and/or independent of the equipment built onto the second side of frame 100. As yet another advantage, cable-based equipment can be removably attached to frame 100 to convert or augment a free weight rack to/with cable weights, all without modifying or replacing frame 100.

The description of particular embodiments of the present invention is now complete. Many of the described features may be substituted, altered or omitted without departing from the scope of the invention. For example, stock having alternate cross-sectional profiles (e.g., rectangular, circle, L-shaped, etc.), may be substituted for the square stock used to form the modular frame, frame extensions, and couplers. As another example, alternate fasteners may be used to attach handles to the steel cable. As yet another example, different materials can be used to manufacture the components described herein. Additionally, many other types of exercise equipment, in addition to those described herein, can be coupled to the receivers of frame 100 or bolted to frame 100. These and other deviations from the particular embodiments shown will be apparent to those skilled in the art, particularly in view of the foregoing disclosure.

We claim:

1. A modular weight station comprising:

a weight rack including a first side support frame, a second side support frame, and a cross support coupled between said first side support frame and said second side support frame, said first side support frame including a first upright, a second upright, a first upper connector coupled between said first upright and said second upright, and a first lower connector coupled between said first upright and said second upright, said second side support frame including a third upright, a fourth upright, a second upper connector coupled between said third upright and said fourth upright, and a second lower connector coupled between said third upright and said fourth upright;

a first set of receivers coupled to said frame and oriented to face in a first direction, each receiver of said first set of receivers being configured to removably engage an additional structural component; and a second set of receivers coupled to said frame and oriented to face in a second direction different from said first direction, each receiver of said second set of receivers being configured to removably engage an additional structural component; and wherein a first receiver of said first set of receivers is fixed to a first end of said first upper connector;

a second receiver of said first set of receivers is fixed to a first end of said second upper connector;

a third receiver of said first set of receivers is fixed to a first end of said first lower connector;

a fourth receiver of said first set of receivers is fixed to a first end of said second lower connector;

a first receiver of said second set of receivers is fixed to a second end of said first upper connector;

a second receiver of said second set of receivers is fixed to a second end of said second upper connector;

a third receiver of said second set of receivers is fixed to a second end of said first lower connector; and a fourth receiver of said second set of receivers is fixed to a second end of said second lower connector.

2. The modular weight station of claim 1, wherein:

said cross support includes a first transverse member coupled between said first upright and said third upright; and said cross support additionally includes a second transverse member coupled between said second upright and said fourth upright.

3. The modular weight station of claim 1, wherein said first upper connector defines a cable passage passing completely through said first upper connector, said cable passage facilitating the movement of a weight cable through said first upper connector.

4. The modular weight station of claim 3, further comprising a cable-weight assembly removably coupled to said weight rack.

5. The modular weight station of claim 1, further comprising:

a first coupler having a first portion and an opposite second portion, said first portion of said first coupler being configured to be removably mounted to said first receiver of said first set of said receivers;

a second coupler having a first portion and an opposite second portion, said first portion of said second coupler being configured to be removably mounted to said third receiver of said first set of said receivers;

a third coupler having a first portion and an opposite second portion, said first portion of said third coupler being configured to be removably mounted to said first receiver of said second set of said receivers;

a fourth coupler having a first portion and an opposite second portion, said first portion of said fourth coupler being configured to be removably mounted to said third receiver of said second set of said receivers;

a first frame extender having a first portion and an opposite second portion, said first portion of said first frame extender being configured to be removably mounted to said second portion of said first coupler;

a second frame extender having a first portion and an opposite second portion, said first portion of said second frame extender being configured to be removably mounted to said second portion of said second coupler;

a third frame extender having a first portion and an opposite second portion, said first portion of said third frame extender being configured to be removably mounted to said second portion of said third coupler; and a fourth frame extender having a first portion and an opposite second portion, said first portion of said fourth frame extender being configured to be removably mounted to said second portion of said fourth coupler.

6. The modular weight station of claim 5, wherein:

said first frame extender is longer than said third frame extender; and said second frame extender is longer than said fourth frame extender.

7. The modular weight station of claim 2, further comprising:

a first coupler having a first portion and an opposite second portion, said first portion of said first coupler being configured to be removably mounted to said first receiver of said first set of said receivers;

a second coupler having a first portion and an opposite second portion, said first portion of said second coupler being configured to be removably mounted to said second receiver of said first set of said receivers;

a third coupler having a first portion and an opposite second portion, said first portion of said third coupler being configured to be removably mounted to said third receiver of said first set of said receivers;

a fourth coupler having a first portion and an opposite second portion, said first portion of said fourth coupler being configured to be removably mounted to said fourth receiver of said first set of said receivers;

a first frame extender having a first portion and an opposite second portion, said first portion of said first frame extender being configured to be removably mounted to said second portion of said first coupler;

a second frame extender having a first portion and an opposite second portion, said first portion of said second frame extender being configured to be removably mounted to said second portion of said second coupler;

a third frame extender having a first portion and an opposite second portion, said first portion of said third frame extender being configured to be removably mounted to said second portion of said third coupler;

a fourth frame extender having a first portion and an opposite second portion, said first portion of said fourth frame extender being configured to be removably mounted to said second portion of said fourth coupler.

8. The modular weight station of claim 7, further comprising:

a fifth coupler having a first portion and an opposite second portion, said first portion of said fifth coupler being configured to be removably mounted to said second portion of said first frame extender;

a sixth coupler having a first portion and an opposite second portion, said first portion of said sixth coupler being configured to be removably mounted to said second portion of said second frame extender;

a seventh coupler having a first portion and an opposite second portion, said first portion of said seventh coupler being configured to be removably mounted to said second portion of said third frame extender;

an eighth coupler having a first portion and an opposite second portion, said first portion of said eighth coupler being configured to be removably mounted to said second portion of said fourth frame extender;

a third side support frame having a lower receiver and an upper receiver, said lower receiver of said third side support frame being configured to be removably mounted to said second portion of said fifth coupler, said upper receiver of said third side support frame being configured to be removably mounted to said second portion of said sixth coupler;

a fourth side support frame having a lower receiver and an upper receiver, said lower receiver of said fourth side support frame being configured to be removably mounted to said second portion of said seventh coupler, said upper receiver of said fourth side support frame being configured to be removably mounted to said second portion of said eighth coupler; and a third transverse member configured to be removably coupled between said third side support frame and said fourth side support frame.

9. The modular weight station of claim 2, further comprising a first coupler having a first portion and an opposite second portion, said first portion of said first coupler being configured to be removably mounted to at least one receiver of said first set of receivers, said second portion of said first coupler being configured to be removably mounted to an additional structural component.

10. The modular weight station of claim 9, wherein said first portion of said first coupler includes a closed-end of said first coupler, said closed-end being disposed to close said at least one receiver of said first set of receivers when said first coupler is mounted to said at least one receiver of said first set of receivers.

11. The modular weight station of claim 9, wherein:

said at least one of said first set of receivers defines a set of apertures;

said first portion of said first coupler defines a set of apertures; and said set of apertures of said first coupler align with said set of apertures of said at least one receiver of said first set of receivers when said first coupler is mounted to said at least one of said first set of receivers.

12. The modular weight station of claim 11, wherein said set of apertures of said first portion of said first coupler are each aligned with a respective thread set of said first portion of said first coupler, said thread sets being configured to engage a threaded fastener.

13. The modular weight station of claim 11, wherein said second portion of said first coupler defines a set of apertures.

14. The modular weight station of claim 13, wherein:

each aperture of said set of apertures of said first portion of said first coupler are spaced apart from one another a first distance;

each aperture of said set of apertures of said second portion of said first coupler are spaced apart from one another a second distance; and said first distance is different than said second distance.

15. The modular weight station of claim 13, wherein said set of apertures of said second portion of said first coupler are each aligned with a respective thread set of said second portion of said first coupler.

16. The modular weight station of claim 11, further comprising a frame extender having a first portion and an opposite second portion, and wherein:

said first portion of said frame extender is configured to be removably mounted to said second portion of said first coupler;

said first portion of said frame extender defines a set of elongated apertures;

said second portion of said first coupler defines a set of apertures;

said set of elongated apertures of said first portion of said frame extender align with said set of apertures defined by said second portion of said first coupler when said first portion of said frame extender is mounted to said second portion of said first coupler.

17. The modular weight station of claim 9, wherein said coupler defines a first cable passage.

18. The modular weight station of claim 17, wherein said coupler defines a second cable passage.

19. The modular weight station of claim 9, wherein said at least one receiver of said first set of receivers includes an open end of a first section of square tube; and said coupler includes a second section of square tube configured to fit into said open end of said first section of square tube.

20. The modular weight station of claim 19, further comprising a frame extender formed from a third section of square tube having the same cross-sectional specifications as said first section of square tube, said second section of square tube being configured to fit into an open end of said third section of square tube.

* * * * *